US010691057B2

(12) United States Patent
Minagawa et al.

(10) Patent No.: US 10,691,057 B2
(45) Date of Patent: Jun. 23, 2020

(54) IMAGE FORMING APPARATUS

(71) Applicant: CANON KABUSHIKI KAISHA, Tokyo (JP)

(72) Inventors: Taisuke Minagawa, Suntou-gun (JP); Ken Yokoyama, Mishima (JP); Yasuharu Hirado, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/450,479

(22) Filed: Jun. 24, 2019

(65) Prior Publication Data

US 2020/0004193 A1 Jan. 2, 2020

(30) Foreign Application Priority Data

Jun. 28, 2018 (JP) ..... 2018-123749

(51) Int. Cl.
*G03G 15/00* (2006.01)
*G03G 15/16* (2006.01)

(52) U.S. Cl.
CPC ..... *G03G 15/80* (2013.01); *G03G 15/1675* (2013.01)

(58) Field of Classification Search
CPC ..... G03G 15/80; G03G 15/5004; G03G 15/2039; G03G 15/1675; H02M 3/33507
USPC ..... 399/88
See application file for complete search history.

(56) References Cited

FOREIGN PATENT DOCUMENTS

| | | | |
|---|---|---|---|
| JP | 9-44007 | A | 2/1997 |
| JP | 11-272092 | A | 10/1999 |
| JP | 2000-98770 | A | 4/2000 |
| JP | 2016-090988 | A | 5/2016 |

*Primary Examiner* — Walter L Lindsay, Jr.
*Assistant Examiner* — Frederick Wenderoth
(74) *Attorney, Agent, or Firm* — Canon U.S.A.Inc., IP Division

(57) ABSTRACT

A controller controls a secondary transfer power source such that a current having a first value flows in a secondary transfer portion in a case where a transfer material with an image formed on a first surface thereof has been conveyed for less than a predetermined amount of time in a second conveyance path. Moreover, the controller controls the secondary transfer power source such that a current having a second value larger in absolute value than the first value flows in the secondary transfer portion in a case where the transfer material with an image formed on the first surface thereof is conveyed to the secondary transfer portion after waiting for the predetermined amount of time or more in the second conveyance path.

28 Claims, 7 Drawing Sheets

IMAGE FORMING APPARATUS

BACKGROUND

Field of the Disclosure

Aspects of the present disclosure generally relate to an image forming apparatus using an electrophotographic recording method, such as a laser printer, a copying machine, and a facsimile apparatus.

Description of the Related Art

In an image forming apparatus using the electrophotographic recording method, when a transfer voltage is applied to a transfer member located opposite to an image bearing member, such as a drum-shaped photosensitive member or an intermediate transfer member, a toner image borne by the image bearing member is electrostatically transferred to a transfer material, such as a sheet of paper or an overhead projector (OHP) sheet. Then, the transfer material with the toner image transferred thereto at a transfer portion formed by the image bearing member and the transfer member is conveyed to a fixing unit and is thus heated and pressed by the fixing unit, so that the toner image is fixed to the transfer material. The fixing unit includes a heating member, such as a heater, and a pressure member, which comes into pressure contact with the heating member to form a fixing nip portion, and, when an alternating-current voltage is applied from an alternating-current source to the heating member, the heating member is heated to such a temperature as to be able to transfer a toner image to the transfer material.

In recent years, image forming apparatuses have been expected to realize further resource saving, so that the use of double-sided printing (two-sided printing or duplex printing) with respect to a transfer material has become diversified. Japanese Patent Application Laid-Open No. 2016-090988 discusses the configuration of an image forming apparatus capable of executing a double-sided print mode which, after conveying a recording material with an image fixed to a first surface thereof to an inversion conveyance path by reversing the rotation of a discharge roller, further transfers a toner image to a second surface of the recording material at an image forming unit.

SUMMARY

Aspects of the present disclosure are generally directed to an image forming apparatus which is capable of forming images on both a first surface of a transfer material and a second surface thereof opposite to the first surface and which is able to reduce or prevent the occurrence of image defect in forming an image on a transfer material that has waited for a predetermined time or more at a conveyance path.

According to an aspect of the present disclosure, an image forming apparatus includes a container unit configured to contain a transfer material, an image bearing member configured to bear a toner image, a transfer member configured to be in contact with the image bearing member to form a transfer portion to transfer a toner image from the image bearing member to a transfer material, a transfer power source configured to apply a voltage to the transfer member, a fixing unit located on a downstream side of the transfer portion in a transfer material conveyance direction and configured to fix a toner image to a transfer material by heating the transfer material, a first conveyance path configured to guide a transfer material being conveyed from the container unit toward the transfer portion, a second conveyance path configured to join the first conveyance path and to guide a transfer material on which an image has been formed on a first surface and which, after passing through the fixing unit, is re-conveyed to the transfer portion, wherein a toner image is transferred to a second surface of the transfer material opposite to the first surface at the transfer portion, and a control unit configured to control the transfer power source such that, in transferring a toner image, a current having a predetermined value flows from the transfer member toward the image bearing member, wherein the control unit controls the transfer power source such that a current having a first value flows from the transfer member toward the image bearing member in a case where the transfer material with an image formed on the first surface thereof has been conveyed for less than a predetermined time in the second conveyance path, and controls the transfer power source such that a current having a second value larger in absolute value than the first value flows from the transfer member toward the image bearing member in a case where the transfer material with an image formed on the first surface thereof is conveyed to the transfer portion after waiting for the predetermined amount of time or more in the second conveyance path.

Further features of the present disclosure will become apparent from the following description of exemplary embodiments with reference to the attached drawings.

DESCRIPTION OF THE EMBODIMENTS

Various exemplary embodiments, features, and aspects of the disclosure will be described in detail below with reference to the drawings. Furthermore, in the following exemplary embodiments, an example in which a laser beam printer is used as an image forming apparatus according to the disclosure is described. However, constituent elements described in the following exemplary embodiments are merely examples, and are, therefore, not intended to limit the scope of the disclosure to those elements.

[Image Forming Apparatus]

Figure 1:
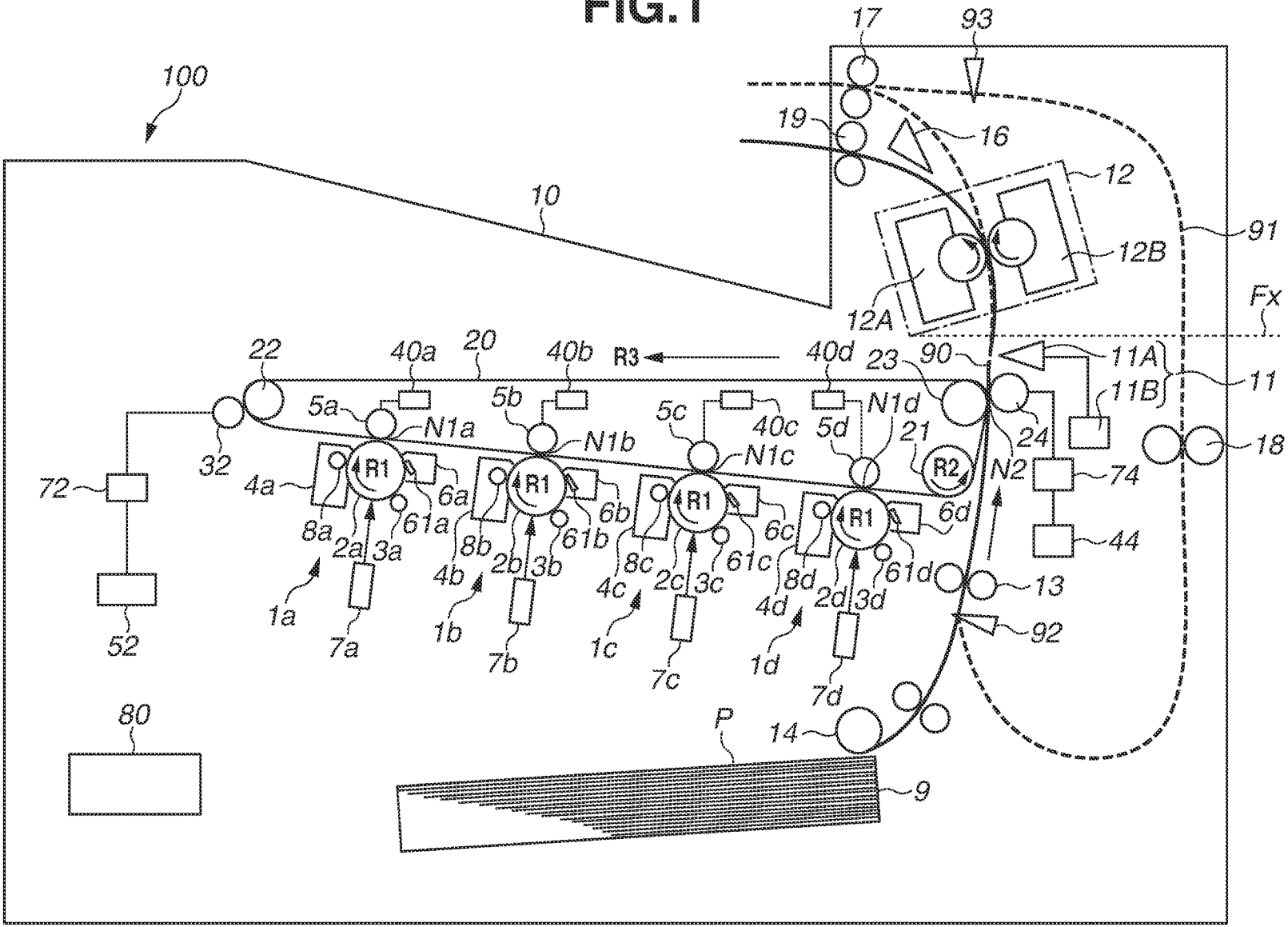
FIG. 1 is a schematic sectional view illustrating a configuration of an image forming apparatus according to a first exemplary embodiment.
Figure 2:
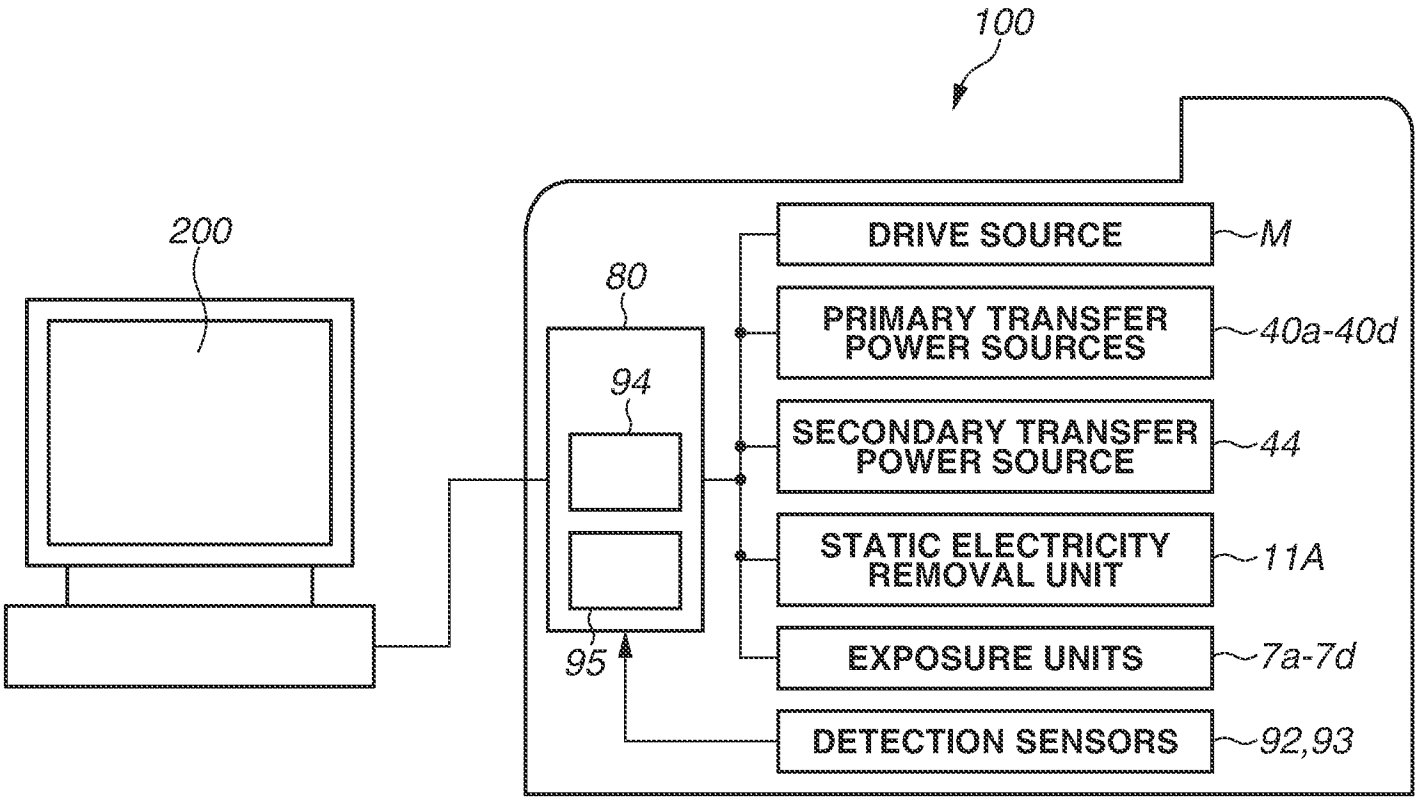
FIG. 2 is a block diagram in the first exemplary embodiment.

FIG. 1 is a schematic sectional view of an image forming apparatus 100 according to a first exemplary embodiment. Moreover, FIG. 2 is a block diagram of a control system for the image forming apparatus 100 in the first exemplary embodiment. As illustrated in FIG. 2, the image forming apparatus 100 is connected to a host computer 200, which is a host device. When an operation start instruction and an image signal generated by the host computer 200 are transmitted to a controller 80, which serves as a control unit, the controller 80 controls various units of the image forming apparatus 100 to allow the image forming apparatus 100 to perform image formation.

The image forming apparatus 100 according to the first exemplary embodiment is a full-color printer of the in-line type and the intermediate transfer type using an electrophotographic method. In the first exemplary embodiment, the image forming apparatus 100 includes a plurality of image forming units, i.e., first, second, third, and fourth image forming units 1*a*, 1*b*, 1*c*, and 1*d*. The first, second, third, and fourth image forming units 1*a*, 1*b*, 1*c*, and 1*d* are configured to form images of the respective colors, yellow, magenta, cyan, and black. These four image forming units 1*a*, 1*b*, 1*c*, and 1*d* are arranged in line at regular intervals.

Furthermore, in the first exemplary embodiment, the configurations of the first to fourth image forming units 1*a* to 1*d* are substantially the same except that developers (toners) to be used differ in color. Accordingly, in the following description, unless a specific distinction is required, suffixes a, b, c, and d, which are assigned to the reference numerals in FIG. 1 to indicate for which color each element is provided, are omitted, so that the first to fourth image forming units 1*a* to 1*d* are collectively described.

As illustrated in FIG. 1, the image forming unit 1 includes a drum-type electrophotographic photosensitive member (hereinafter referred to as a "photosensitive drum 2"), which is configured to bear toner. Moreover, a drum charging roller 3, a developing unit 4, a primary transfer roller 5, which serves as a primary transfer member, and a cleaning unit 6, which is configured to recover toner remaining on the photosensitive drum 2, are provided around the photosensitive drum 2. The developing units 4*a*, 4*b*, 4*c*, and 4*d* contain toners of the respective colors, yellow, magenta, cyan, and black, and supply the respective toners to the respective corresponding photosensitive drums 2. An exposure unit 7 (laser scanner) is located below a space between the drum charging roller 3 and the developing unit 4 as viewed in FIG. 1.

Moreover, in the image forming apparatus 100 according to the first exemplary embodiment, an intermediate transfer belt 20, which is an endless intermediate transfer member, is located in such a way as to face all of the photosensitive drums 2*a* to 2*d* of the respective image forming units 1*a* to 1*d*. The intermediate transfer belt 20 is suspended in a tensioned manner by a driving roller 21, a tensile suspension roller 22, and a secondary transfer counter roller 23, which serve as a plurality of supporting members, and is driven to rotate by the driving roller 21, which rotates in the direction of arrow R2 in FIG. 1, thus moving in the direction of arrow R3 in FIG. 1. Furthermore, primary transfer portions N1*a* to N1*d* are formed at the respective positions at which the intermediate transfer belt 20 is in contact with the respective photosensitive drums 2*a* to 2*d*.

The primary transfer roller 5, which is able to come into contact with the inner circumferential surface of the intermediate transfer belt 20, is located at a position facing the photosensitive drum 2 across the intermediate transfer belt 20. Moreover, a secondary transfer roller 24 serving as a secondary transfer member (transfer member), which is in contact with the outer circumferential surface of the intermediate transfer belt 20 to form a secondary transfer portion N2, is located at a position facing the secondary transfer counter roller 23 (hereinafter referred to as a "counter roller 23") across the intermediate transfer belt 20.

The photosensitive drum 2 in the first exemplary embodiment is an organic photo conductor (OPC) drum of the negatively charged type, and includes a photosensitive layer formed on a drum substrate made from aluminum. The photosensitive drum 2 is driven by a drive source M (illustrated in FIG. 2) to rotate in the direction of arrow R1 (clockwise) in FIG. 1 at a predetermined circumferential velocity (surface movement velocity). In the first exemplary embodiment, the circumferential velocity of the photosensitive drum 2 is equivalent to a process speed of the image forming apparatus 100.

The intermediate transfer belt 20 used in the first exemplary embodiment is an intermediate transfer belt made from polyethylene naphthalate (PEN) resin. The initial surface resistivity of the intermediate transfer belt 20 is $5.0\times10^{11}$ Ω/sq, and the volume resistivity thereof is $8.0\times10^{11}$ Ωcm.

Besides, the intermediate transfer belt 20 can be made from, for example, polyvinylidene fluoride (PVDF) resin, ethylene tetrafluoroethylene (ETFE) resin, polyimide resin, polyethylene terephthalate (PET) resin, or polycarbonate resin. Alternatively, the intermediate transfer belt 20 can be, for example, a belt configured in an endless belt shape by coating the surface of a rubber base layer made from, for example, ethylene propylene diene rubber (EPDM) with an urethane rubber in which fluorine resin, such as polytetrafluoroethylene (PTFE), is dispersed.

The primary transfer roller 5 is made from, for example, an elastic member such as sponge rubber. In the first exemplary embodiment, the primary transfer roller 5 is a roller configured by coating a nickel-plated steel rod of 6 mm in diameter with nitrile rubber (NBR) epichlorhydrin rubber of 4 mm in thickness. The electrical resistance value of the primary transfer roller 5 is $1.0\times10^{5}$Ω in a case where, while the primary transfer roller 5 is pressed against an aluminum cylinder with a force of 9.8 N and is rotated at 50 mm/sec, a voltage of 100 V is applied to the primary transfer roller 5.

Moreover, the primary transfer roller 5 is located at a position facing the photosensitive drum 2 across the intermediate transfer belt 20, and is configured to press the intermediate transfer belt 20 against the photosensitive drum 2, thus forming a primary transfer portion N1. Then, the primary transfer roller 5 rotates by being driven by the movement of the intermediate transfer belt 20. A primary transfer power source 40 is connected to the primary transfer roller 5, and the primary transfer power source 40 is able to apply a voltage of positive polarity or negative polarity to the primary transfer roller 5.

The secondary transfer roller 24 is made from, for example, an elastic member, such as sponge rubber. In the first exemplary embodiment, the secondary transfer roller 24 is a roller configured by coating a nickel-plated steel rod of 6 mm in diameter with nitrile rubber (NBR) epichlorhydrin rubber of 6 mm in thickness. The electrical resistance value of the secondary transfer roller 24 is $3.0\times10^{7}$Ω in a case where, while the secondary transfer roller 24 is pressed against an aluminum cylinder with a force of 9.8 N and is rotated at 50 mm/sec, a voltage of 1,000 V is applied to the secondary transfer roller 24.

The secondary transfer roller 24 is in contact with the intermediate transfer belt 20 at a position facing the counter roller 23, thus forming a secondary transfer portion N2. A secondary transfer power source 44 is connected to the secondary transfer roller 24, and the secondary transfer power source 44 is able to apply a voltage of positive polarity or negative polarity to the secondary transfer roller 24.

A conductive roller 32, which serves as a charging member that electrically charges toner remaining on the intermediate transfer belt 20, is provided on the downstream side of the secondary transfer portion N2 with respect to the movement direction of the intermediate transfer belt 20. Details of the configuration and operation of a charging unit are described below.

A sheet feeding cassette 9, which serves as a container unit that contains transfer materials P, a sheet feeding roller 14, a detection sensor 92, and a registration roller 13, which serves as a conveyance member that conveys a transfer material P toward the secondary transfer portion N2, are arranged on the upstream side of the secondary transfer portion N2 with respect to the conveyance direction of the transfer material P. The sheet feeding roller 14 is a feeding member that feeds a transfer material P contained in the sheet feeding cassette 9, and the detection sensor 92 is a detection unit that is able to detect the leading edge and trailing edge of the transfer material P fed by the sheet feeding roller 14.

A static electricity removal unit 11, which removes the static electricity of the transfer material P, is located on the downstream side of the secondary transfer portion N2 with respect to the conveyance direction of the transfer material P. The static electricity removal unit 11 has a fore-end formed in a saw-toothed shape, and includes a static electricity removal needle 11A (static electricity removal member), which is fixedly located perpendicularly to the conveyance direction of the transfer material P and opposite to the reverse surface of the transfer material P at a distance therefrom, and a static electricity removal power source 11B, which applies a voltage to the static electricity removal needle 11A. Selectable examples of the static electricity removal needle 11A include a metallic brush, a conductive resin fiber, and a metallic wire. In the first exemplary embodiment, a static electricity removal voltage of −200 V is applied from the static electricity removal power source 11B to the static electricity removal needle 11A during a period from before the leading edge of the transfer material P in the conveyance direction thereof arrives at the secondary transfer portion N2 to when the trailing edge of the transfer material P sufficiently moves away from the secondary transfer portion N2 and the static electricity removal needle 11A.

A fixing unit 12, which serves as a fixing unit that fixes a toner image to the transfer material P by heating the transfer material P with the toner image transferred thereto, is provided on the downstream side of the static electricity removal unit 11 with respect to the conveyance direction of the transfer material P. The fixing unit 12 includes a fixing roller 12A, which is equipped with a heat source, and a pressure roller 12B, which is in pressure contact with the fixing roller 12A.

Additionally, a diverter 16, which serves as a switching member that switches between a first conveyance path 90 and a second conveyance path 91, a discharge roller 19, which serves as a discharging unit, a reversing roller 17, which serves as a reversing unit, and a sheet discharge tray 10, which serves as a stacking portion, are provided on the downstream side of the fixing unit 12. The discharge roller 19 discharges a transfer material P with image formation completed thereon to the sheet discharge tray 10. Moreover, in the case of performing image formation on both sides of the transfer material P, the reversing roller 17 conveys the transfer material P with an image formed on the first surface thereof from the first conveyance path 90 toward the second conveyance path 91.

Next, the first conveyance path 90 and the second conveyance path 91 are described. The first conveyance path 90 is configured to guide a transfer material P fed from the sheet feeding cassette 9 or a transfer material P with an image formed on the first surface thereof conveyed to the second conveyance path 91 by the reversing roller 17, to the secondary transfer portion N2. The downstream side of the first conveyance path 90 with respect to the conveyance direction of the transfer material P is connected to the reversing roller 17 and the discharge roller 19, and the upstream side of the first conveyance path 90 is connected to the sheet feeding cassette 9 and the second conveyance path 91. Furthermore, the transfer material P conveyed to the first conveyance path 90 is able to be guided to the reversing roller 17 or the discharge roller 19 by switching the position of the diverter 16.

The transfer material P with an image formed on the first surface thereof which is re-conveyed toward the secondary transfer portion N2 so as to form an image on the second surface of the transfer material P, which is opposite to the first surface, is conveyed to the second conveyance path 91 by the reversing roller 17 and is then guided to the first conveyance path 90 by the second conveyance path 91. Then, the transfer material P is guided by the first conveyance path 90 and is thus pinched by the secondary transfer portion N2 again. The upstream side of the second conveyance path 91 with respect to the conveyance direction of the transfer material P is connected to the reversing roller 17, and the downstream side of the second conveyance path 91 joins the first conveyance path 90. Moreover, a detection sensor 93 (detection unit), which is able to detect the leading edge and trailing edge of the transfer material P with an image formed on the first surface thereof, and a conveyance roller 18, which conveys the transfer material P in the second conveyance path 91, are provided at the second conveyance path 91.

[Image Forming Operation]

Next, an image forming operation in the image forming apparatus 100 with a full-color mode taken as an example is described with reference to FIG. 1.

First, when an image forming operation start signal is issued, the photosensitive drum 2 is driven to rotate in the direction of arrow R1 in FIG. 1 at a predetermined circumferential velocity, and is electrically charged by the drum charging roller 3 during the process of rotation, so that a uniform electric potential is formed on the surface of the photosensitive drum 2. The drum charging roller 3 is in contact with the photosensitive drum 2 at a predetermined contact pressure, and, when receiving a predetermined voltage applied from a charging power source (not illustrated), the drum charging roller 3 electrically charges the surface of the photosensitive drum 2 at a predetermined uniform electric potential. In the first exemplary embodiment, the photosensitive drum 2 is electrically charged to a negative polarity by the drum charging roller 3.

The exposure unit 7 performs exposure on the surface of the photosensitive drum 2 to form an electrostatic latent image corresponding to image information on the surface of the photosensitive drum 2 electrically charged by the drum charging roller 3. More specifically, the exposure unit 7 outputs, from a laser output portion, laser light modulated in association with time-series electrical digital pixel signals representing image information input from the host computer 200. Then, the surface of the photosensitive drum 2 is irradiated with the laser light radiated via a reflection mirror, so that an electrostatic latent image is formed on the surface of the photosensitive drum 2.

The developing unit 4 uses a contact developing method as a developing method thereof, and includes a development roller 8, which serves as a developer bearing member that is in contact with the photosensitive drum 2. The development roller 8 is driven to rotate by a drive unit (not illustrated), and toner borne in a thin layer manner on the development roller 8 is conveyed to a developing portion at which the photosensitive drum 2 and the development roller 8 are in contact with each other. Then, when a voltage is applied from a developing power source (not illustrated) to the development roller 8, an electrostatic latent image formed on the photosensitive drum 2 is developed as a toner image.

An electrostatic latent image formed on the photosensitive drum 2 is developed in a reversal developing method. More specifically, toner electrically charged to the same polarity as the charging polarity of the photosensitive drum 2 (in the first exemplary embodiment, a negative polarity) is caused to adhere to an exposure portion of the photosensitive drum 2 exposed to light by the exposure unit 7, so that an electrostatic latent image is developed as a toner image. Here, the normal charging polarity of toner contained in the developing unit 4 is a negative polarity.

Furthermore, while, in the first exemplary embodiment, the contact developing method is used, the first exemplary embodiment is not limited to this, but a non-contact developing method can be used. Moreover, while, in the first exemplary embodiment, the reversal developing method is used to develop an electrostatic latent image, the first exemplary embodiment is not limited to this, but the present disclosure can be applied to an image forming apparatus which positively develops an electrostatic latent image with toner electrically charged to a polarity opposite to the charging polarity of the photosensitive drum 2.

In the primary transfer portion N1, when a voltage of positive polarity, which is a polarity opposite to the normal charging polarity of toner, is applied from the primary transfer power source 40 to the primary transfer roller 5, a toner image developed on the photosensitive drum 2 is primarily transferred from the photosensitive drum 2 to the intermediate transfer belt 20. In this way, in the respective primary transfer portions N1, toner images of the respective colors are primarily transferred to the intermediate transfer belt 20 sequentially in a superposed manner, so that a multiple toner image, which is composed of toner images of a plurality of colors, is formed on the intermediate transfer belt 20.

The registration roller 13 conveys the transfer material P to the secondary transfer portion N2 in conformity with timing at which the leading edge of the toner images of a plurality of colors primarily transferred to the intermediate transfer belt 20 arrives at the secondary transfer portion N2. Then, when a voltage of positive polarity, which is a polarity opposite to the normal charging polarity of toner, is applied from the secondary transfer power source 44 to the secondary transfer roller 24, the toner images of a plurality of colors are collectively secondarily transferred from the intermediate transfer belt 20 to the transfer material P in the secondary transfer portion N2.

Then, the transfer material P with the toner images of a plurality of colors secondarily transferred thereto is conveyed to the fixing unit 12 and is then heated and pressed by the fixing roller 12A and the pressure roller 12B, so that toners of a plurality of colors are fused and mixed in color and are thus fixed to the transfer material P. Then, the transfer material P with the toner images of a plurality of colors fixed thereto is discharged to the outside of the image forming apparatus 100, so that a sequence of the image forming operation ends.

In a case where image formation is performed on only one side (the first surface) of the transfer material P, the transfer material P with a toner image fixed to the first surface thereof is guided toward the discharge roller 19 by the diverter 16, and, after being discharged by the discharge roller 19, is then stacked on the sheet discharge tray 10.

On the other hand, in a case image formation is performed on both sides (the first surface and the second surface) of the transfer material P, the transfer material P with a toner image fixed to the first surface thereof is guided to the reversing roller 17 by the diverter 16. Although the reversing roller 17 once conveys the transfer material P toward the sheet discharge tray 10, since the rotation direction of the reversing roller 17 is switched before the trailing edge of the transfer material P is discharged to the sheet discharge tray 10, the reversing roller 17 conveys the transfer material P toward the second conveyance path 91. Then, after being conveyed to the first conveyance path 90 by the conveyance roller 18, the transfer material P is conveyed to the secondary transfer portion N2 by the registration roller 13, so that, in the secondary transfer portion N2, a toner image is transferred to the second surface of the transfer material P. Then, the transfer material P with images formed on both the first surface and second surface thereof is guided toward the discharge roller 19 by the diverter 16, and, after being discharged by the discharge roller 19, is then stacked on the sheet discharge tray 10.

Toner remaining on the photosensitive drum 2 after primary transfer is removed from the photosensitive drum 2 by a cleaning blade 61, which serves as a contact member formed from an elastic member such as urethane rubber, and is then recovered by the cleaning unit 6, which serves as a recovery unit that recovers toner.

Moreover, toner remaining on the intermediate transfer belt 20 without being secondarily transferred to the transfer material P (hereinafter referred to as "residual transfer toner") moves together with the intermediate transfer belt 20 and is then electrically charged by the conductive roller 32. Then, the residual transfer toner moves together with the intermediate transfer belt 20, and, when passing through the primary transfer portion N1, the residual transfer toner electrostatically moves from the intermediate transfer belt 20 to the photosensitive drum 2 due to a potential difference between the photosensitive drum 2 and the intermediate transfer belt 20, and is then recovered by the cleaning unit 6.

[Recovery Operation for Residual Transfer Toner]

As illustrated in FIG. 1, the conductive roller 32 is located in contact with the intermediate transfer belt 20 on the downstream side of the secondary transfer portion N2 and on the upstream side of the primary transfer portion N1*a* with respect to the movement direction of the intermediate transfer belt 20. Moreover, the conductive roller 32 is electrically connected to a charging power source 52 via a current detection unit 72, and the charging power source 52 is able to apply a voltage of positive polarity or negative polarity to the conductive roller 32.

In the first exemplary embodiment, the conductive roller 32 (roller member) is a roller configured by coating a nickel-plated steel rod of 6 mm in diameter with a solid elastic member of 5 mm in thickness made from an EPDM in which carbon is dispersed. The electrical resistance value of the conductive roller 32 is $5.0\times10^7$ Ω in a case where, while the conductive roller 32 is pressed against an aluminum cylinder with a force of 9.8 N and is rotated at 50 mm/sec, a voltage of 500 V is applied to the conductive roller 32. The conductive roller 32 is pressed toward the tensile suspension roller 22 via the intermediate transfer belt 20 with a total pressure of 9.8 N.

Toner borne on the intermediate transfer belt 20 before secondary transfer is electrically charged to a negative polarity, which is the same polarity as the charging polarity of the surface of the photosensitive drum 2, and is in a state in which the variation in distribution of electric charges is small. On the other hand, residual transfer toner remaining on the intermediate transfer belt 20 after secondary transfer is in a state in which the distribution of electric charges is broad, and has a tendency to have a distribution in which the peak is shifted to the positive polarity side, which is a polarity opposite to the normal charging polarity of toner. In other words, residual transfer toner remaining on the intermediate transfer belt 20 after secondary transfer is in a state in which toner electrically charged to the negative polarity, toner hardly electrically charged, and toner electrically charged to the positive polarity are mixed.

Figure 3A:
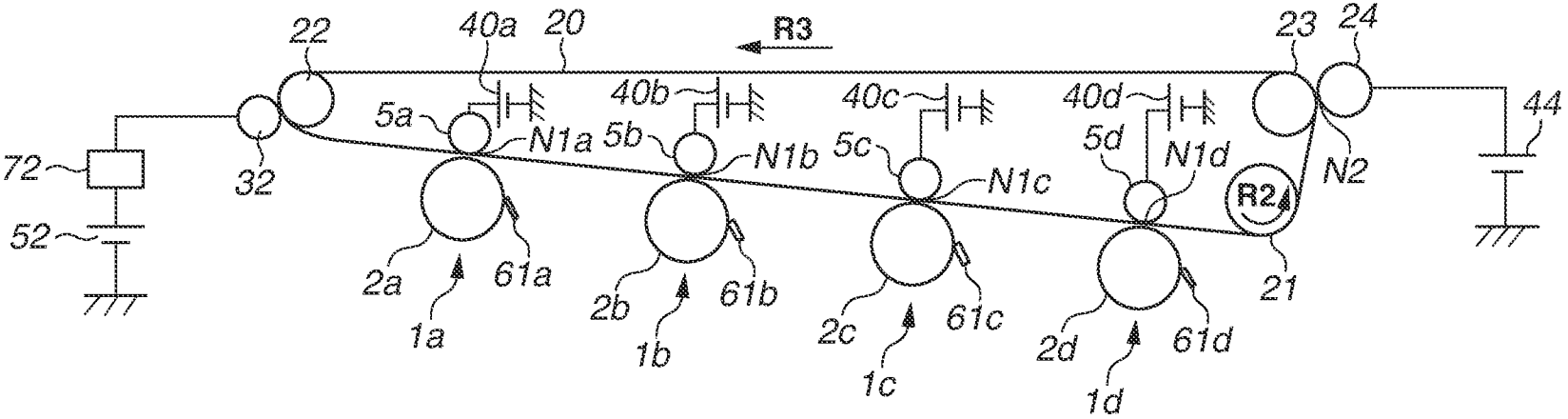
FIG. 3A is a schematic diagram illustrating a first recovery operation in the first exemplary embodiment.
Figure 3B:
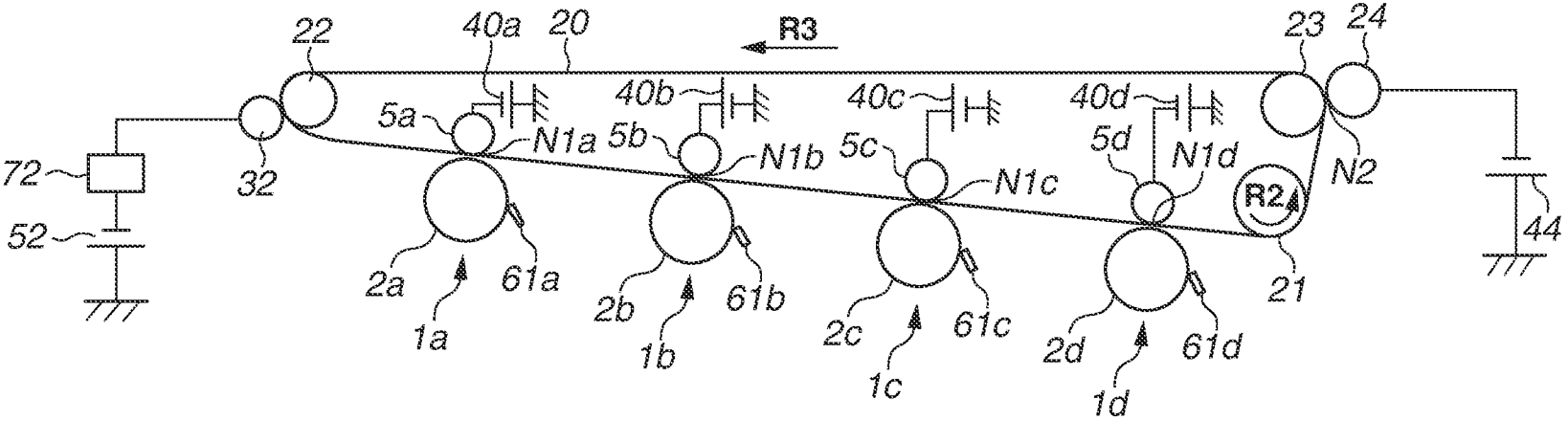
FIG. 3B is a schematic diagram illustrating a second recovery operation in the first exemplary embodiment.

The image forming apparatus 100 in the first exemplary embodiment is able to perform a first recovery operation and a second recovery operation, which are described below, when causing the cleaning unit 6 to recover residual transfer toner. FIG. 3A is a schematic diagram illustrating a first recovery operation in which, after the conductive roller 32 electrically charges residual transfer toner to a polarity (in the first exemplary embodiment, a positive polarity) opposite to the normal charging polarity of toner, the cleaning unit 6 recovers the residual transfer toner. Moreover, FIG. 3B is a schematic diagram illustrating a second recovery operation in which, after residual transfer toner adhering to the conductive roller 32 is caused to move from the conductive roller 32 to the intermediate transfer belt 20, the cleaning unit 6 recovers the residual transfer toner.

<First Recovery Operation>

As illustrated in FIG. 3A, in the case of recovering residual transfer toner by the first recovery operation, a direct-current voltage of positive polarity is applied from the charging power source 52 to the conductive roller 32. The output value of the direct-current voltage is controlled based on the current value detected by the current detection unit 72 in such a manner that the value of a current flowing from the conductive roller 32 toward the intermediate transfer belt 20 becomes a previously set target current value (subjected to constant current control). In this case, such a value as not to excessively electrically charge residual transfer toner and not to cause defective cleaning due to insufficient electric charging is set as the target current value. In the first exemplary embodiment, the target current value for use in performing the first recovery operation is set to 30 μA.

In response to a voltage of positive polarity being applied from the charging power source 52 to the conductive roller 32, the residual transfer toner is electrically charged to the positive polarity in a position at which the conductive roller 32 and the intermediate transfer belt 20 are in contact with each other. The residual transfer toner, which has been electrically charged to the positive polarity and has passed through the position at which the conductive roller 32 and the intermediate transfer belt 20 are in contact with each other, moves in association with the movement of the intermediate transfer belt 20 and then arrives at the primary transfer portion N1*a* of the most upstream image forming unit. Then, in response to a voltage of positive polarity being applied from the primary transfer power source 40*a* to the primary transfer roller 5*a*, the residual transfer toner, which has been electrically charged to the positive polarity, electrostatically moves from the intermediate transfer belt 20 to the photosensitive drum 2*a*.

Then, the residual transfer toner of positive polarity, which has moved to the photosensitive drum 2*a*, is recovered to the cleaning unit 6*a* by the cleaning blade 61*a*. In this way, a recovery operation for residual transfer toner which has been electrically charged to the positive polarity and has passed through the position at which the conductive roller 32 and the intermediate transfer belt 20 are in contact with each other (first recovery operation) is performed.

Here, in comparison with the second recovery operation, which is described below, in the first recovery operation, the voltage which is applied to the primary transfer roller 5 so as to recover residual transfer toner is of positive polarity. In other words, in the primary transfer portion N1, applying a voltage of positive polarity to the primary transfer roller 5 enables electrostatically moving residual transfer toner from the intermediate transfer belt 20 to the photosensitive drum 2 while transferring a toner image from the photosensitive drum 2 to the intermediate transfer belt 20. Accordingly, the first recovery operation is able to be performed concurrently with the image forming operation, so that it is not necessary to provide such a waiting time as to stop the conveyance of the transfer material P and cause the transfer material P to wait at a conveyance path.

<Second Recovery Operation>

As mentioned above, the residual transfer toner which has passed through the secondary transfer portion N2 may include toner electrically charged to the negative polarity. Such toner electrically charged to the negative polarity electrostatically adheres to the conductive roller 32, to which a voltage of positive polarity has been applied in the first recovery operation. If the amount of toner which adheres to the conductive roller 32 increases, the residual transfer toner becomes less able to be electrically charged in the first recovery operation, so that defective cleaning may occur. Therefore, in the first exemplary embodiment, the second recovery operation, which, after moving toner of negative polarity adhering to the conductive roller 32 to the intermediate transfer belt 20 at predetermined timing, electrostatically moves the toner from the intermediate transfer belt 20 to the photosensitive drum 2, thus recovering the toner, is performed.

As illustrated in FIG. 3B, in the case of recovering residual transfer toner by the second recovery operation, a direct-current voltage of negative polarity is applied from the charging power source 52 to the conductive roller 32. This enables electrostatically moving toner of negative polarity adhering to the conductive roller 32 to the intermediate transfer belt 20. Then, the toner of negative polarity, which has been discharged from the conductive roller 32 to the intermediate transfer belt 20, arrives at the primary transfer portion N1*a* of the most upstream image forming unit.

At this time, applying a voltage of negative polarity to at least one of the primary transfer rollers 5*a* to 5*d* enables moving a toner image from the intermediate transfer belt 20 to any one of the photosensitive drums 2*a* to 2*d*. As illustrated in FIG. 3B, in the first exemplary embodiment, applying a voltage of negative polarity from the primary transfer power sources 40*a* and 40*d* to the primary transfer rollers 5*a* and 5*d* causes residual transfer toner of negative polarity to electrostatically move from the intermediate transfer belt 20 to the photosensitive drums 2*a* and 2*d*. The toner which has moved to the photosensitive drums 2*a* and 2*d* is recovered to the cleaning units 6*a* and 6*d* by the cleaning blades 61*a* and 61*d* in association with the rotation of the respective photosensitive drums 2, as with the first recovery operation.

In this way, while the polarity of a voltage which is applied to the primary transfer roller 5 during image formation is a positive polarity, in the second recovery operation, it is necessary to apply a voltage of negative polarity to the primary transfer roller 5. Accordingly, the second recovery operation is performed during a non-image forming operation, such as a post-rotation operation after image formation or a pre-rotation operation before image formation, or is performed in a state in which image formation is temporarily stopped. In the case of performing the second recovery operation in a state in which image formation is temporarily stopped, it is necessary to provide such a waiting time to temporarily stop the conveyance of the transfer material P and cause the transfer material P to wait at, for example, a conveyance path.

Furthermore, in the above description, a configuration in which residual transfer toner electrically charged to the positive polarity or negative polarity is recovered at the photosensitive drum 2*a* located on the most upstream side with respect to the movement direction of the intermediate transfer belt 20 or at the photosensitive drum 2*d* located on the most downstream side has been described. However, the first exemplary embodiment is not limited to this, but controlling the direction of an electric field which is formed at each primary transfer portion N1 enables recovering residual transfer toner at a photosensitive drum other than the photosensitive drum 2*a* and the photosensitive drum 2*d*. For example, controlling the value of a voltage which is applied to the drum charging roller 3, the intensity of exposure which is performed by the exposure unit 7, or the polarity and output value of a voltage which is applied from the primary transfer power source 40 to the primary transfer roller 5 enables controlling the direction of an electric field which is formed at each primary transfer portion N1. Moreover, controlling the direction of an electric field which is formed at each primary transfer portion N1 also enables recovering residual transfer toner at a plurality of photosensitive drums in a sharing manner <Execution Frequency of Second Recovery Operation>

To prevent or reduce a decrease in the charging performance of the conductive roller 32, it is desirable that the execution frequency of the second recovery operation be higher in a condition in which the amount of residual transfer toner is larger. Specifically, it is desirable that the execution frequency of the second recovery operation be set based on the amount of toner which is used for an image to be formed (hereinafter referred to as a "printing rate") or the number of sheets of transfer material P used for image formation. In the first exemplary embodiment, a configuration in which the second recovery operation is performed at frequencies shown in Table 1 below is employed.

TABLE 1

Execution frequency of second recovery operation in first exemplary embodiment

| | Average printing rate | | | |
|---|---|---|---|---|
| | less than 5% | 5% or more and less than 10% | 10% or more and less than 25% | 25% or more and less than 50% |
| Execution frequency | for every printing of 151 images | for every printing of 91 images | for every printing of 61 images | for every printing of 31 images |

Furthermore, one image in Table 1 represents an image which is formed on one side of the transfer material P, and, in the case of performing image formation on both sides, the obverse side and reverse side, of the transfer material P, two images are counted. Moreover, the average printing rate in Table 1 is a value which is calculated by the following calculation method.

First, the calculation method performs color separation of image information input from the host computer 200 into a time-series color image signal with respect to each image forming unit 1. Next, the calculation method calculates the ratio of the number of pixels subjected to exposure by the exposure unit 7 (the number of pixels subjected to image formation) to the number of all of the image pixels at each image forming unit 1, thus calculating the average printing rate (Pix_n) at each image forming unit 1 according to the following formula (1).

$$\text{"Average printing rate Pix_}n\text{ [\%] of each image forming unit"} = (\text{"the number of pixels subjected to exposure by the exposure unit 7 at each image forming unit"}/\text{"the number of all of the pixels"}) \times 100 \quad (1)$$

In formula (1), n denotes 1 to 4 and thus represents the numbers of the respective image forming units 1*a* to 1*d*. In other words, the average printing rate of the image forming unit 1*a* is denoted by Pix_1, the average printing rate of the image forming unit 1*b* is denoted by Pix_2, the average printing rate of the image forming unit 1*c* is denoted by Pix_3, and the average printing rate of the image forming unit 1*d* is denoted by Pix_4. Then, the calculation method calculates the average printing rate [%] according to the following formula (2) with use of the average printing rates of the respective image forming units obtained by formula (1).

$$\text{"Average printing rate [\%]"} = (\text{Pix_1}+\text{Pix_2}+\text{Pix_3}+\text{Pix_4})/4 \quad (2)$$

Furthermore, while, in the first exemplary embodiment, a control operation of performing the second recovery operation for every predetermined number of images that is based on the printing rate as shown in Table 1 has been described, the first exemplary embodiment is not limited to this. For example, a configuration in which a look-up table (LUT) of count values set according to the printing rates is previously stored in a memory 94 of the controller 80 and the second recovery operation is performed at predetermined timing based on the printing rate calculated from image information and the LUT can be employed.

[Change of Resistance Value of Transfer Material Waiting at Second Conveyance Path 91]

Here, an operation of the image forming apparatus 100 and a physical property change of the transfer material P in a case where the above-mentioned waiting time has occurred due to the second recovery operation being performed during the process of conveyance of the transfer material P in the second conveyance path 91 are described.

First, a case where a waiting time has occurred in forming images on both sides, the first surface and the second surface, of the transfer material P is described. In the case of performing the second recovery operation, since it is not possible to perform an image forming operation as mentioned above, it is necessary to cause the transfer material P to wait at a predetermined position for a predetermined time until the second recovery operation is completed. In the first exemplary embodiment, the transfer material P is caused to wait on the upstream side of the registration roller 13 with respect to the conveyance direction of the transfer material P in the second conveyance path 91 illustrated in FIG. 1.

Next, a physical property change of the transfer material P which occurs during the waiting time is described. The second conveyance path 91 is configured with various rollers for use in conveyance and various plastic components (not illustrated). Moreover, as illustrated in FIG. 1, the second conveyance path 91 has a region located on the upstream side of a downstream side end portion Fx of the position at which the fixing unit 12 is provided with respect to the conveyance direction of the transfer material P in the second conveyance path 91. Therefore, in a case where the transfer material P has been caused to wait in the second conveyance path 91, a part or the whole area of the transfer material P may be warmed by a component in the conveyance path indirectly warmed by the heat of the fixing unit 12 during image formation or may be warmed by the heat of the fixing unit 12 thrusting into the conveyance path. In particular, if the waiting time for causing the transfer material P to wait in the second conveyance path 91 becomes long, this tendency becomes conspicuous. While, if the transfer material P is warmed, changes of various physical property values are supposed, particularly, in terms of secondary transferability, which is described below, the degree of influence of such a factor as a variation in resistance value is large.

Figure 4:
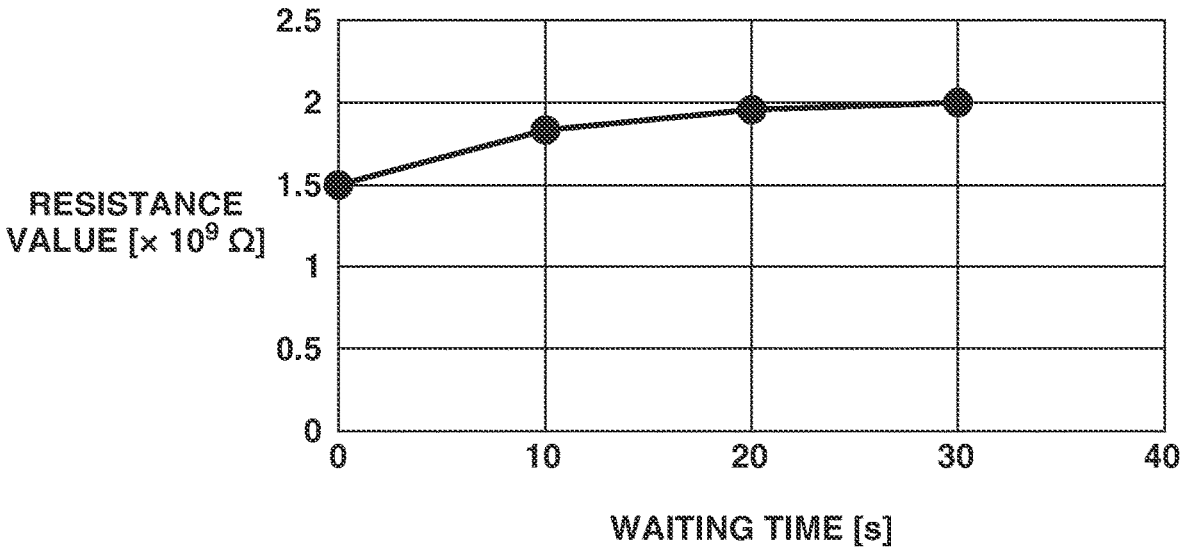
FIG. 4 is a graph representing a relationship between a waiting time for which a transfer material has waited in a second conveyance path and a resistance value of the transfer material in the first exemplary embodiment.

FIG. 4 is a graph illustrating a relationship between the time for which the transfer material P waits in the second conveyance path 91 and the resistance value of the transfer material P in the image forming apparatus 100 in the first exemplary embodiment. Futura GLOSS COVER (grammage: 216 g/m$^2$, size: Letter size) manufactured by VERSO Corporation was used as the transfer material P, and the resistance value was measured with use of Hiresta-Up MCP-HT450 (manufactured by Mitsubishi Chemical Analytech Co., Ltd.). The measurement environment was set to be a temperature of 23° C. and a humidity of 50%, and the transfer material P without a toner image formed on the first surface thereof was caused to pass through the secondary transfer portion N2, and, after being reversed by the reversing roller 17, was caused to wait in the second conveyance path 91.

As illustrated in FIG. 4, such a tendency that, as the waiting time increased, the resistance value of the transfer material P increased was observed. This is considered to be because, in the second conveyance path 91, due to the transfer material P being heated by, for example, the heat of the fixing unit 12, moisture included in the transfer material P evaporated along with the progress of the waiting time, so that the transfer material P was dried and the resistance value thereof increased. Moreover, as illustrated in FIG. 4, such a tendency that the amount of increase of the resistance value was large until the waiting time became about 20 seconds was also observed.

Furthermore, in the first exemplary embodiment, a state in which the transfer material P is temporarily stopped from being conveyed in the second conveyance path 91 and is caused to wait in the vicinity of the registration roller 13 has been described, the condition under which the physical property of the transfer material P changes is not limited to this state. As the time for which the transfer material P is situated in the second conveyance path 91 warmed by the heat of the fixing unit 12 is longer, the above-mentioned variation of the resistance value is more likely to occur. In other words, even in a case where, although the conveyance of the transfer material P is not stopped during the waiting time, the time for which the transfer material P passes through the second conveyance path 91 is made longer by decreasing the conveyance speed of the transfer material P, the above-mentioned variation of the resistance value may occur.

[Setting of Target Current Value for Secondary Transfer]

In the secondary transfer portion N2 during an image forming operation, a secondary transfer voltage of the polarity (in the first exemplary embodiment, a positive polarity) opposite to the normal charging polarity of toner is applied from the secondary transfer power source 44 to the secondary transfer roller 24, so that a multiple toner image borne on the intermediate transfer belt 20 is collectively secondarily transferred to the transfer material P. In the configuration of the image forming apparatus 100 in the first exemplary embodiment, the output value of the secondary transfer voltage is controlled based on the current value detected by the current detection unit 74 in such a manner that the value of a current flowing from the secondary transfer roller 24 toward the intermediate transfer belt 20 becomes a previously set target current value (subjected to constant current control).

Here, in a case where the target current value for secondary transfer is smaller than an appropriate range, it becomes difficult to form an electric field used to secondarily transfer a multiple toner image borne on the intermediate transfer belt 20 to the transfer material P in the secondary transfer portion N2, so that secondary transfer partially becomes incomplete. As a result, an image defect in which an image with partial unevenness occurring (a coarse defective image) is formed may occur.

On the other hand, in a case where the target current value for secondary transfer is larger than the appropriate range, in the secondary transfer portion N2, a partially strong discharge phenomenon may occur between the intermediate transfer belt 20 and the transfer material P. If this discharge phenomenon becomes conspicuous, the decrease of the amount of charging of toner borne on the intermediate transfer belt 20 or the reversal of charging polarity thereof would occur. Since toner with the amount of charging decreased or toner with the charging polarity reversed becomes unlikely to electrostatically move from the intermediate transfer belt 20 to the transfer material P under the action of an electric field formed at the secondary transfer portion N2, naturally, secondary transfer becomes incomplete. As a result, an image defect in which an image with unevenness totally or locally occurring (a strong defective image) is formed may occur.

Setting the target current value for secondary transfer to a range effective for preventing or reducing the occurrence of the above-mentioned coarse defective image or strong defective image enables attaining good secondary transferability. Furthermore, in the first exemplary embodiment, the target current value for secondary transfer is previously stored in the memory 94 of the controller 80 as a look-up table (LUT) based on, for example, types of the transfer material P or the surrounding environment of the image forming apparatus 100.

Here, in the secondary transfer portion N2, at an end portion in the width direction (longitudinal direction) of the transfer material P, which intersects with the conveyance direction of the transfer material P, there exists a region in which, during image formation, the secondary transfer roller 24 and the intermediate transfer belt 20 come into direct contact with each other without via the transfer material P (a non-sheet passage region). The non-sheet passage region has a smaller impedance than that of a region in which the transfer material P is pinched (a sheet passage region), as the transfer material P does not exist in the non-sheet passage region during image formation. Thus, at the time of image formation, a part of the current flowing from the secondary transfer roller 24 to the intermediate transfer belt 20 would flow preferentially to the non-sheet passage region, which has a low impedance. In particular, under a condition in which the resistance of the transfer material P becomes large, since the impedance of the sheet passage region becomes larger than that of the non-sheet passage region, the amount of current flowing to the non-sheet passage region tends to increase. Accordingly, in the case of setting the above-mentioned target current value for secondary transfer, it is favorable to perform setting in consideration of the amount of current flowing to the non-sheet passage region.

[Image Defect which Occurs Due to Insufficient Static Electricity Removal for Transfer Material P]

In the secondary transfer portion N2 in the process of an image forming operation, a voltage of the polarity (in the first exemplary embodiment, a positive polarity) opposite to the normal charging polarity of toner is applied from the secondary transfer power source 44 to the secondary transfer roller 24. At this time, under the influence of discharging in the secondary transfer portion N2, electric charges of the polarity opposite to the normal charging polarity of toner are also applied to the reverse surface of the transfer material P. However, if the quantity of electric charge applied to the reverse surface of the transfer material P becomes excessive, when the transfer material P has come close to a member that constitutes the conveyance path, a discharge phenomenon in a direction to reduce charging of the transfer material P may occur. In particular, in a case where such a discharge phenomenon has occurred at a relatively large influence rate in a portion of the transfer material P, a toner image formed on the surface of the transfer material P is disturbed, so that an image defect called a polka-dotted image may occur.

The method of preventing or reducing the occurrence of such an image defect can include a method of providing the static electricity removal unit 11 such as that illustrated in FIG. 1. Specifically, applying a voltage of the polarity (negative polarity) opposite to that of the electric charge applied to the reverse surface of the transfer material P from the static electricity removal power source 11B to the static electricity removal needle 11A enables removing the electric charging of positive polarity of the reverse surface of the transfer material P, thus preventing or reducing the occurrence of image defect. However, depending on the amount of charging of the reverse surface of the transfer material P, the electric charging of the reverse surface of the transfer material P may not be able to be sufficiently removed by the static electricity removal needle 11A. In the following description, an image defect (polka-dotted image) which occurs due to insufficient static electricity removal for the transfer material P is described with reference to FIGS. 5A and 5B.

Figure 5A:
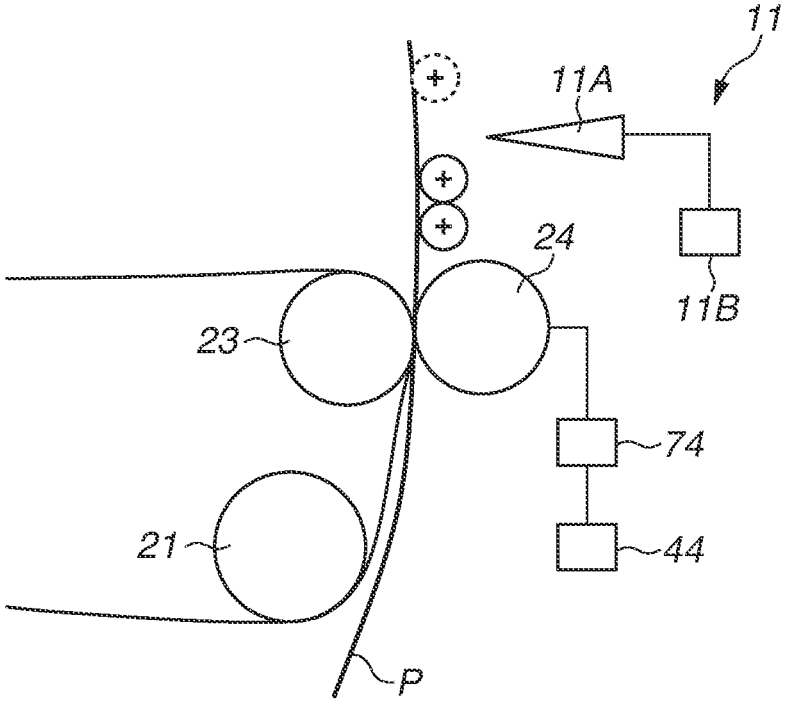
FIG. 5A is a schematic diagram illustrating static electricity removal from a transfer material in a case where sufficient electric charges have been applied to the reverse surface of the transfer material.
Figure 5B:
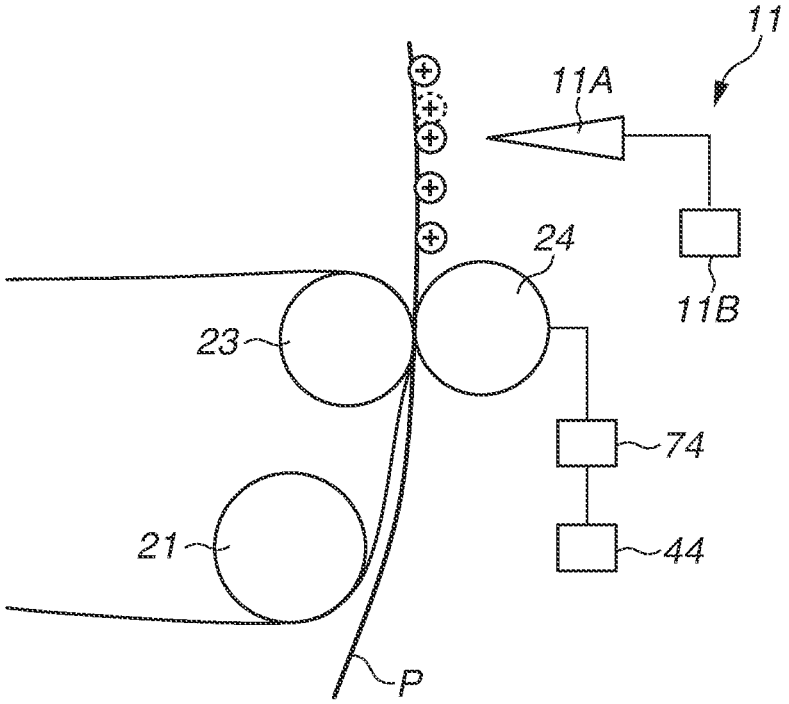
FIG. 5B is a schematic diagram illustrating static electricity removal from a transfer material in a case where sufficient electric charges have not been applied to the reverse surface of the transfer material.

FIG. 5A is a schematic diagram illustrating a state in which the electric charging of the reverse surface of the transfer material P has been able to be sufficiently removed by the static electricity removal unit 11, and FIG. 5B is a schematic diagram illustrating a state in which the electric charging of the reverse surface of the transfer material P has not been able to be sufficiently removed by the static electricity removal unit 11. Furthermore, in FIGS. 5A and 5B, the electrically charged state is denoted by a solid-line circle mark with a "+" sign written therein, the static-electricity-removed state is denoted by a dashed-line circle mark with a "+" sign written therein, and the amount of charging of the transfer material P is denoted by the size of each circle mark. Moreover, in the examples illustrated in FIGS. 5A and 5B, voltages to be applied from the static electricity removal power source 11B to the static electricity removal needle 11A (static electricity removal voltages) are assumed to have the same value.

As illustrated in FIG. 5A, in a case where the quantity of electric charge of the reverse surface of the transfer material P is relatively large, a potential difference between the transfer material P electrically charged to the positive polarity and the static electricity removal needle 11A with a voltage of negative polarity applied thereto tends to become large. As a result, the static electricity removal for the transfer material P is accelerated by an electric discharge which occurs between the transfer material P and the static electricity removal needle 11A, so that electric charges on the reverse surface of the transfer material P are efficiently removed.

On the other hand, as illustrated in FIG. 5B, in a case where the quantity of electric charge of the reverse surface of the transfer material P is relatively small, a potential difference between the transfer material P and the static electricity removal needle 11A tends to become small. As a result, a discharge phenomenon occurring between the transfer material P and the static electricity removal needle 11A is not accelerated, so that it becomes difficult to sufficiently remove the electric charging of the reverse surface of the transfer material P, and a polka-dotted image may be generated. Such insufficient static electricity removal is likely to occur in a case where the quantity of electric charge applied to the reverse surface of the transfer material P is small, for example, in a case where the target current value for secondary transfer is small or in a case where the resistance value of the transfer material P is high.

[Secondary Transfer Control Corresponding to Waiting Time]

Figure 6:
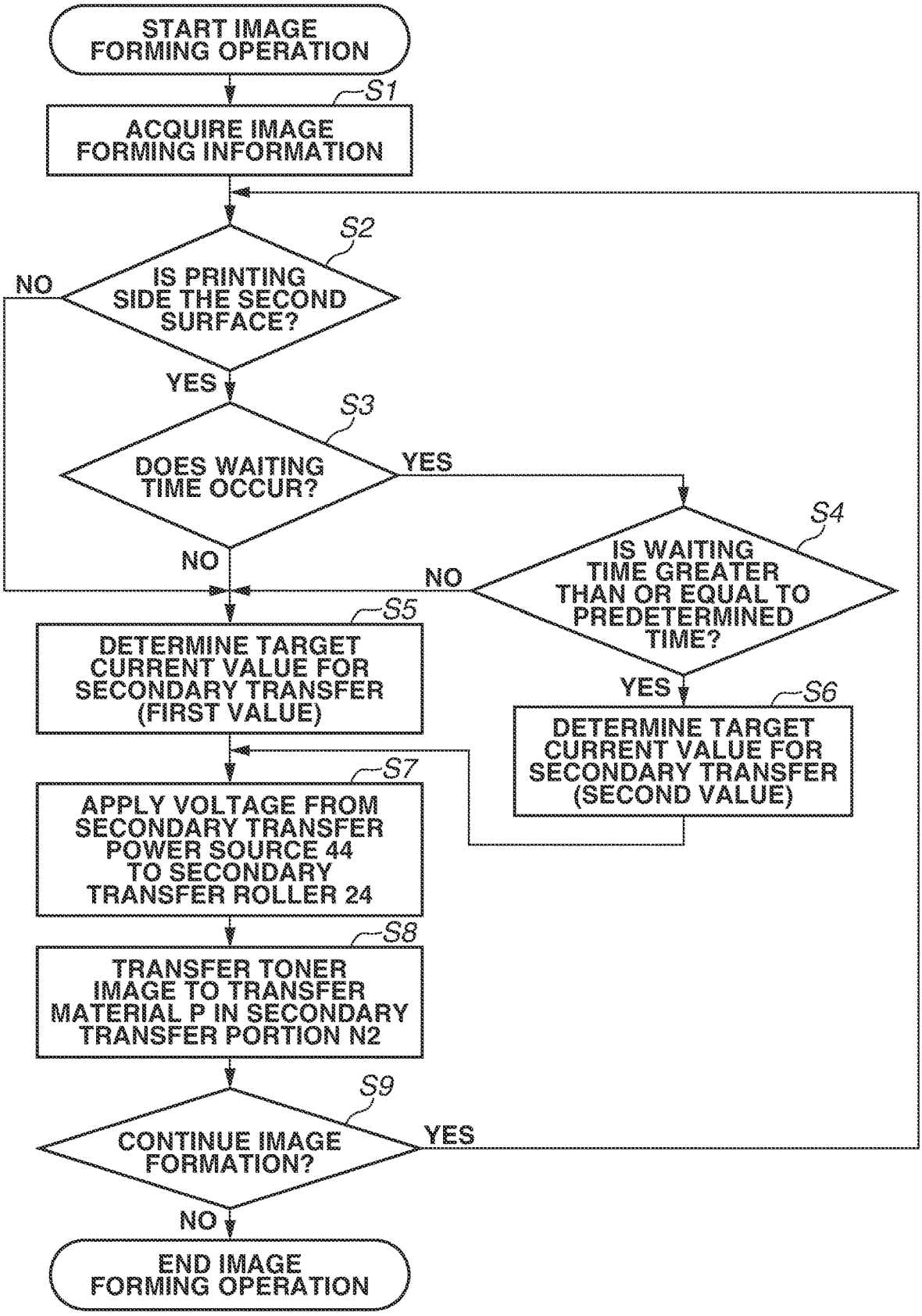
FIG. 6 is a flowchart illustrating control which is performed during secondary transfer in the first exemplary embodiment.

FIG. 6 is a flowchart illustrating control which is performed during secondary transfer in the first exemplary embodiment. In the first exemplary embodiment, in a case where the transfer material P has waited in the second conveyance path 91 for a predetermined time or more, control which changes the target current value for secondary transfer is performed to prevent or reduce the occurrence of various image defects due to the increase of the resistance value of the transfer material P.

When the controller 80 receives a start signal for the image forming operation from the host computer 200, as illustrated in FIG. 6, first, in step S1, the controller 80 acquires various pieces of image forming information required to perform image formation. Next, in step S2, the controller 80 determines, based on the image forming information, whether the printing side used for image formation is the second surface, and, if it is determined that the printing side is not the second surface (NO in step S2), then in step S5, the controller 80 determines a target current value for secondary transfer (first value) corresponding to the information, such as grammage or surrounding environment, previously acquired in step S1. Then, in step S7, the controller 80 applies a voltage from the secondary transfer power source 44 to the secondary transfer roller 24, and, in step S8, the controller 80 transfers a toner image from the intermediate transfer belt 20 to the transfer material P in the secondary transfer portion N2 according to constant current control in which the target current value is set to the first value. After completion of secondary transfer, then in step S9, the controller 80 determines whether to continue image formation, and, if it is determined not to continue image formation (NO in step S9), the controller 80 ends the image forming operation and, if it is determined to continue image formation (YES in step S9), the controller 80 returns the processing to step S2.

If, in step S2, it is determined that the printing side is the second surface (YES in step S2), then in step S3, the controller 80 determines whether a waiting time for waiting in the second conveyance path 91 occurs. If it is determined that the waiting time occurs (YES in step S3), then in step S4, the controller 80 determines whether the waiting time is greater than or equal to a predetermined time. Furthermore, if, in step S3, it is determined that the waiting time does not occur (NO in step S3), or if, in step S4, it is determined that the waiting time is less than the predetermined time (NO in step S4), the controller 80 advances the processing to step S5, so that the controller 80 performs the image forming operation in the flow of step S5 and subsequent steps.

If, in step S4, it is determined that the waiting time is greater than or equal to the predetermined time (YES in step S4), then in step S6, the controller 80 determines that the resistance value of the transfer material P which has been waiting in the second conveyance path 91 has increased and then determines a target current value for secondary transfer (second value) corresponding to such an increase. Then, in step S7, the controller 80 applies a voltage from the secondary transfer power source 44 to the secondary transfer roller 24, and, in step S8, the controller 80 transfers a toner image from the intermediate transfer belt 20 to the transfer material P in the secondary transfer portion N2 according to constant current control in which the target current value is set to the second value.

The target current values for secondary transfer (the first value and the second value) are values which are to be set as appropriate according to, for example, the grammage and size of the transfer material P, the surrounding environment of the image forming apparatus 100, and whether the printing side is the first surface or second surface. In the first exemplary embodiment, the target current values for secondary transfer (the first value and the second value) are previously stored as a look-up table (LUT) in the memory 94 of the controller 80.

In the first exemplary embodiment, the waiting time of the transfer material P is measured by the detection sensor 93 provided in the second conveyance path 91 and a counter 95 provided in the controller 80. Specifically, the waiting time is able to be measured by the detection sensor 93 detecting the leading edge of the transfer material P, which has been conveyed to the second conveyance path 91 by the reversing roller 17, and by the counter 95 counting a time elapsed from such detection timing. Here, the leading edge of the transfer material P is a fore-end of the transfer material P in the conveyance direction thereof in the second conveyance path 91. Moreover, the waiting time does not need to be measured only by the detection sensor 93. For example, another detection sensor provided in the second conveyance path 91 can also be used to measure the waiting time.

With regard to the first exemplary embodiment, a comparative example 1, and a comparative example 2, the presence or absence of occurrence of image defect was checked and evaluated as follows. Table 2 shows evaluation results compiled with respect to the first exemplary embodiment, the comparative example 1, and the comparative example 2. Furthermore, the evaluation of the presence or absence of occurrence of image defect was performed with use of an image forming apparatus which was capable of conveying a transfer material P of A3 size. As the evaluation condition, the process speed was set to 60 mm/sec and a glossy paper mode was selected as the image forming mode. Moreover, as the transfer material P, Futura GLOSS COVER (grammage: 216 g/m$^2$, size: Letter size) manufactured by VERSO Corporation was used, and the measurement environment for evaluation was set to be a temperature of 23° C. and a humidity of 50%.

As an evaluation image to be formed on the first surface and the second surface of the transfer material P, margins at the leading edge, trailing edge, right end, and left end of the transfer material P were set to 5 mm, and a halftone image was output with the exposure unit 7*d* of the black image forming unit 1*d* performing light emission in such a manner that the printing rate became about 20%. Such an evaluation image was formed on 35 sheets of the transfer material P in the double-sided printing mode (70 images) as a continuous job. In this case, while image formation was continuously performed on sheets of the transfer material P, the second recovery operation was performed once in the state in which the transfer material P not yet subjected to image formation on the second surface thereof was waiting in the second conveyance path 91. Specifically, the second recovery operation was performed for about 25 seconds in the state in which the transfer material P stopped from being conveyed was waiting in the second conveyance path 91.

In the first exemplary embodiment, the predetermined time in step S4 illustrated in FIG. 6 was set to 20 seconds, and the target current value for secondary transfer (second value) used to transfer a toner image to the second surface of the transfer material P in a case where the waiting time greater than or equal to the predetermined time occurred was set to 16 μA. Moreover, the target current value for secondary transfer (first value) used to transfer a toner image to the second surface of the transfer material P in a case where the waiting time did not occur was set to 7 μA.

In the configuration of the comparative example 1, the target current value for secondary transfer used to transfer a toner image to the second surface of the transfer material P was set to 7 μA irrespective of the presence or absence of occurrence of a waiting time. Moreover, in the configuration of the comparative example 2, the target current value for secondary transfer used to transfer a toner image to the second surface of the transfer material P was set to 16 μA irrespective of the presence or absence of occurrence of a waiting time. Furthermore, the configurations of the comparative example 1 and the comparative example 2 are substantially the same as that of the first exemplary embodiment except for setting of the target current value for secondary transfer used to transfer a toner image to the second surface of the transfer material P. Accordingly, in the following description, portions similar to those in the first exemplary embodiment are assigned the respective same reference numerals, and are omitted from description.

TABLE 2

Evaluation results in first exemplary embodiment, comparative example 1, and comparative example 2

| | Absence of occurrence of waiting time | | Presence of occurrence of waiting time (25 seconds) | |
|---|---|---|---|---|
| | target current value for secondary transfer to second surface | Image defect | target current value for secondary transfer to second surface | Image defect |
| First exemplary embodiment | 7 μA | Absence | 16 μA | Absence |
| Comparative example 1 | 7 μA | Absence | 7 μA | Presence |
| Comparative example 2 | 16 μA | Presence | 16 μA | Absence |

As shown in Table 2, in the first exemplary embodiment, image defect did not occur regardless of the presence of absence of occurrence of a waiting time. On the other hand, in the comparative example 1, while image defect did not occur in the case of absence of occurrence of a waiting time, image defect occurred in a case where a waiting time occurred due to the second recovery operation being performed. This is considered to be because the resistance value of the transfer material P increased due to the transfer material P being caused to wait in the second conveyance path 91, and image defect due to insufficient static electricity removal was observed. Moreover, in the comparative example 2, while image defect did not occur in a case where a waiting time occurred due to the second recovery operation being performed, in the case of absence of occurrence of a waiting time, an image defect in which, due to the target current value for secondary transfer becoming excessive, unevenness partially occurred in an image subjected to secondary transfer occurred.

As described above, in the configuration of the first exemplary embodiment, in a case where the transfer material P has waited a predetermined time or more in the second conveyance path 91, the controller 80 changes a current flowing from the secondary transfer roller 24 toward the intermediate transfer belt 20 to transfer a toner image to the second surface of the transfer material P. More specifically, in the case of transferring a toner image to the first surface of the transfer material P, the controller 80 controls the secondary transfer power source 44 in such a manner that a current with the first value flows from the secondary transfer roller 24 toward the intermediate transfer belt 20. Then, in the case of transferring a toner image to the second surface of the transfer material P which has waited for a predetermined time or more in the second conveyance path 91, the controller 80 controls the secondary transfer power source 44 in such a manner that a current with the second value greater than the first value flows from the secondary transfer roller 24 toward the intermediate transfer belt 20. This enables preventing or reducing the occurrence of image defect and appropriately forming an image even with respect to the transfer material P with the resistance value thereof having increased due to the transfer material P waiting for a predetermined time or more in the second conveyance path 91.

Furthermore, in the first exemplary embodiment, a configuration in which the target current value for secondary transfer which is set to form a toner image on the first surface and the target current value for secondary transfer which is set to form a toner image on the second surface are set to the same value (first value) has been described. However, these target current values are values which are to be set as appropriate according to the resistance value of the transfer material P and the surrounding environment of the image forming apparatus 100. To attain the advantageous effect of the first exemplary embodiment, the target current value for secondary transfer (second value) in a case where the waiting time is a predetermined time or more only needs to be set to a value different from the target current value for secondary transfer (first value) in a case where the waiting time is less than the predetermined time. In other words, the first exemplary embodiment is not limited to a configuration of the image forming apparatus in which the target current value for secondary transfer which is set to form a toner image on the first surface and the target current value for secondary transfer which is set to form a toner image on the second surface are set to the same value.

Moreover, while, in the first exemplary embodiment, a configuration in which the predetermined time in step S4 is set to 20 seconds and the target current value for secondary transfer is selected from two values, the first value and second value, has been described, the first exemplary embodiment is not limited to this configuration. The predetermined time can be set as appropriate according to, for example, the configuration of the image forming apparatus 100, types of the transfer material P, or the image forming condition, such as the fixing temperature of the fixing unit 12. Moreover, a configuration in which the target current value for secondary transfer is set as appropriate according to a time for which the transfer material P has waited in the second conveyance path 91 can be employed. In this case, for example, a formula for determining the target current value for secondary transfer with the waiting time used as a variable can be employed, or a configuration in which a look-up table (LUT) having target current values corresponding to a plurality of waiting times is provided in the controller 80 can be employed.

In the first exemplary embodiment, the controller 80 is configured to perform control (constant current control) in such a manner that the value of a current flowing from the secondary transfer roller 24 toward the intermediate transfer belt 20 becomes a previously set target current value, thus secondarily transferring a toner image from the intermediate transfer belt 20 to the transfer material P. However, the first exemplary embodiment is not limited to this, but the controller 80 can be configured to perform constant voltage control to apply a previously set predetermined voltage (transfer voltage) from the secondary transfer power source 44 to the secondary transfer roller 24, thus secondarily transferring a toner image from the intermediate transfer belt 20 to the transfer material P. Furthermore, the transfer voltages in constant voltage control can be configured to be previously stored in the memory 94 of the controller 80 as a look-up table (LUT), or can be configured to be set as appropriate based on a result of detection of an impedance of the secondary transfer portion N2 before transfer.

In the case of using the constant voltage control, when the transfer material P has waited for a predetermined time or more in the second conveyance path 91, the controller 80 changes a voltage which is applied from the secondary transfer power source 44 to the secondary transfer roller 24 to transfer a toner image to the second surface with respect to a voltage which is used in the case of transferring a toner image to the first surface. This enables attaining a similar advantageous effect to that in the first exemplary embodiment. More specifically, in the case of transferring a toner image to the first surface, the controller 80 applies a voltage with a first value from the secondary transfer power source 44 to the secondary transfer roller 24. Then, in the case of transferring a toner image to the second surface of the transfer material P which has waited for a predetermined time or more in the second conveyance path 91, the controller 80 applies a voltage with a second value greater than the first value from the secondary transfer power source 44 to the secondary transfer roller 24. This enables preventing or reducing the occurrence of image defect and appropriately forming an image even with respect to the transfer material P with the resistance value thereof having increased due to the transfer material P waiting for a predetermined time or more in the second conveyance path 91.

Moreover, while, in the first exemplary embodiment, a configuration in which, in a case where the resistance value of the transfer material P waiting in the second conveyance path 91 increases, the target current value for secondary transfer to the second surface is changed to a value larger than the target current value for secondary transfer to the first surface has been described, the first exemplary embodiment is not limited to this configuration. For example, depending on the amount of moisture of the transfer material P or the frequency of use of the image forming apparatus 100 or in a surrounding environment higher in temperature and higher in humidity than that in the first exemplary embodiment, a case where the amount of moisture of the transfer material P waiting in the second conveyance path 91 increases may be expected. Employing a configuration in which, when such a case is detected, control is performed in a direction to decrease the target current value for secondary transfer enables preventing or reducing an image defect which occurs due to the target current value for secondary transfer becoming excessive.

Additionally, in the first exemplary embodiment, an example in which, when the second recovery operation is performed as cleaning control for the intermediate transfer belt 20, a waiting time occurs due to the transfer material P waiting in the second conveyance path 91 has been described. However, such a waiting time is not limited to cleaning control. For example, a similar waiting time to that in the first exemplary embodiment can occur even with regard to a time required for the controller 80 to perform color separation of image information input from the host computer 200 into a time-series color image signal (an image rasterization time). Moreover, a similar waiting time to that in the first exemplary embodiment can occur even when, for example, dehumidification control which temporarily interrupts the image forming operation and causes the fixing unit 12 to operate so as to dehumidify the inside of the image forming apparatus is performed. Moreover, a similar waiting time to that in the first exemplary embodiment can occur with regard to a time for which image formation is temporarily interrupted, such as a cool-down time (a temperature rise prevention time) required to decrease the temperature of a surrounding member indirectly warmed in a case where a heating fixing operation of the fixing unit 12 is continuously performed. Even in such cases, using the configuration of the first exemplary embodiment enables preventing or reducing the occurrence of image defect.

Figure 7:
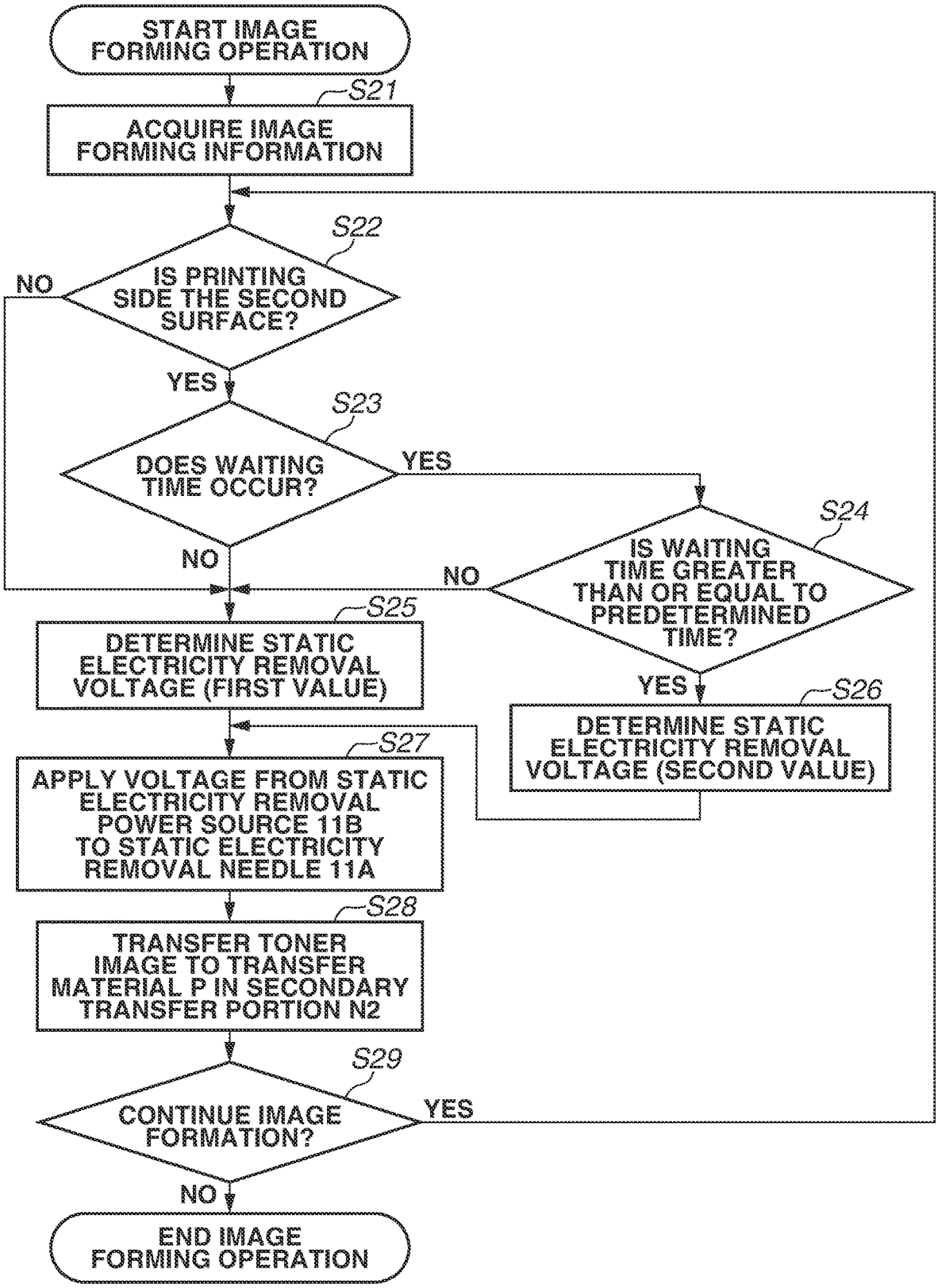
FIG. 7 is a flowchart illustrating static electricity removal control in a second exemplary embodiment.

In the above-described first exemplary embodiment, a configuration in which, in a case where the time for which the transfer material P waits in the second conveyance path 91 becomes a predetermined time or more, the occurrence of image defect is prevented or reduced by making the target current value for secondary transfer different between the first surface and the second surface has been described. On the other hand, in a second exemplary embodiment, as illustrated in FIG. 7, a configuration in which, in a case where the time for which the transfer material P waits in the second conveyance path 91 becomes a predetermined time or more, the value of a voltage which is applied from the static electricity removal power source 11B to the static electricity removal needle 11A is made different between the first surface and the second surface of the transfer material P is described. Furthermore, the configuration of the second exemplary embodiment is the same as the configuration of the first exemplary embodiment except that the voltage which is applied to the static electricity removal needle 11A (hereinafter referred to as a "static electricity removal voltage") is made different between the first surface and the second surface of the transfer material P. Accordingly, portions similar to those in the first exemplary embodiment are assigned the respective same reference numerals as those in the first exemplary embodiment, and are omitted from description.

In the first exemplary embodiment, a configuration in which the target current value for secondary transfer used in forming an image on the second surface is set larger than that used in forming an image on the first surface, thus increasing the quantity of electric charge applied to the reverse surface of the transfer material P, promoting a discharge phenomenon between the transfer material P and the static electricity removal needle 11A, and preventing or reducing the occurrence of a polka-dotted image has been employed. On the other hand, in the second exemplary embodiment, the controller 80 controls the static electricity removal power source 11B in such a manner that the absolute value of the static electricity removal voltage used in forming an image on the second surface becomes larger than the absolute value of the static electricity removal voltage used in forming an image on the first surface. In the following description, details thereof are described with reference to FIG. 7. FIG. 7 is a flowchart illustrating control over the static electricity removal unit 11 in the second exemplary embodiment.

When the controller 80 receives a start signal for the image forming operation from the host computer 200, as illustrated in FIG. 7, first, in step S21, the controller 80 acquires various pieces of image forming information required to perform image formation. Next, in step S22, the controller 80 determines, based on the image forming information, whether the printing side used for image formation is the second surface, and, if it is determined that the printing side is not the second surface (NO in step S22), then in step S25, the controller 80 determines a static electricity removal voltage (first value) corresponding to the information, such as grammage or surrounding environment, previously acquired in step S21. Then, in step S27, the controller 80 applies a static electricity removal voltage with the first value from the static electricity removal power source 11B to the static electricity removal needle 11A, and, in step S28, the controller 80 transfers a toner image to the transfer material P which is conveyed from the second conveyance path 91 to the secondary transfer portion N2. After completion of secondary transfer, then in step S29, the controller 80 determines whether to continue image formation, and, if it is determined not to continue image formation (NO in step S29), the controller 80 ends the image forming operation and, if it is determined to continue image formation (YES in step S29), the controller 80 returns the processing to step S22.

If, in step S22, it is determined that the printing side is the second surface (YES in step S22), then in step S23, the controller 80 determines whether a waiting time for waiting in the second conveyance path 91 occurs. If it is determined that the waiting time occurs (YES in step S23), then in step S24, the controller 80 determines whether the waiting time is greater than or equal to a predetermined time. Furthermore, if, in step S23, it is determined that the waiting time does not occur (NO in step S23), or if, in step S24, it is determined that the waiting time is less than the predetermined time (NO in step S24), the controller 80 advances the processing to step S25, so that the controller 80 performs the image forming operation in the flow of step S25 and subsequent steps.

If, in step S24, it is determined that the waiting time is greater than or equal to the predetermined time (YES in step S24), then in step S26, the controller 80 determines that the resistance value of the transfer material P which has been waiting in the second conveyance path 91 has increased and then determines a static electricity removal voltage (second value) corresponding to such an increase. Then, the controller 80 advances the processing to step S27, so that the controller 80 performs the image forming operation in the flow of step S27 and subsequent steps.

The static electricity removal voltages (the first value and the second value) are values which are to be set as appropriate according to, for example, the grammage and size of the transfer material P, the surrounding environment of the image forming apparatus 100, and whether the printing side is the first surface or second surface. In the second exemplary embodiment, the static electricity removal voltages (the first value and the second value) are previously stored as a look-up table (LUT) in the memory 94 of the controller 80. Moreover, the method of measuring the waiting time in the second exemplary embodiment is the same as that in the first exemplary embodiment and is, therefore, omitted from description.

With regard to the second exemplary embodiment, a comparative example 3, and a comparative example 4, the presence or absence of occurrence of image defect was checked and evaluated as follows. Table 3 shows evaluation results compiled with respect to the second exemplary embodiment, the comparative example 3, and the comparative example 4. Furthermore, the evaluation of the presence or absence of occurrence of image defect was performed under a similar condition to that in the first exemplary embodiment.

In the second exemplary embodiment, the predetermined time in step S24 illustrated in FIG. 7 was set to 20 seconds, and the static electricity removal voltage (second value) used in forming an image on the second surface of the transfer material P in a case where the waiting time greater than or equal to the predetermined time occurred was set to −1,000 V. Moreover, the static electricity removal voltage (first value) used in forming an image on the second surface of the transfer material P in a case where the waiting time did not occur was set to −200 V.

In the configuration of the comparative example 3, the static electricity removal voltage used in forming an image on the second surface of the transfer material P was set to −200 V irrespective of the presence or absence of occurrence of a waiting time. Moreover, in the configuration of the comparative example 4, the static electricity removal voltage used in forming an image on the second surface of the transfer material P was set to −1,000 V irrespective of the presence or absence of occurrence of a waiting time. Furthermore, the configurations of the comparative example 3 and the comparative example 4 are substantially the same as that of the second exemplary embodiment except for setting of the static electricity removal voltage used in forming an image on the second surface of the transfer material P. Accordingly, in the following description, portions similar to those in the second exemplary embodiment are assigned the respective same reference numerals, and are omitted from description.

TABLE 3

Evaluation results in second exemplary embodiment, comparative example 3, and comparative example 4

| | Absence of occurrence of waiting time | | Presence of occurrence of waiting time (25 seconds) | |
|---|---|---|---|---|
| | static electricity removal voltage to second surface | Image defect | static electricity removal voltage to second surface | Image defect |
| Second exemplary embodiment | −200 V | Absence | −1,000 V | Absence |
| Comparative example 3 | −200 V | Absence | −200 V | Presence |
| Comparative example 4 | −1,000 V | Presence | −1,000 V | Absence |

As shown in Table 3, in the second exemplary embodiment, image defect did not occur regardless of the presence of absence of occurrence of a waiting time. On the other hand, in the comparative example 3, while image defect did not occur in the case of absence of occurrence of a waiting time, image defect occurred in a case where a waiting time occurred due to the second recovery operation being performed. This is considered to be because the resistance value of the transfer material P increased due to the transfer material P being caused to wait in the second conveyance path 91 and sufficient electric charges were not applied to the reverse surface of the transfer material P due to the static electricity removal voltage being small, so that the static electricity removal by the static electricity removal needle 11A was insufficient.

Moreover, in the comparative example 4, image defect did not occur in a case where a waiting time occurred due to the second recovery operation being performed. However, in the case of absence of occurrence of a waiting time, an image defect caused by a locally large discharge occurring between the static electricity removal needle 11A and the reverse surface of the transfer material P due to an excessive static electricity removal voltage being set with respect to the amount of charging of the reverse surface of the transfer material P was observed. Specifically, an electric discharge from the static electricity removal needle 11A caused an image defect called a static electricity removal needle streak image in which a toner image on the transfer material P was disturbed at intervals of tips of the static electricity removal needle 11A.

As described above, in the configuration of the second exemplary embodiment, in a case where the transfer material P has waited a predetermined time or more in the second conveyance path 91, the controller 80 changes a static electricity removal voltage which is applied to the static electricity removal needle 11A to form an image on the second surface. More specifically, in the case of forming an image on the first surface of the transfer material P, the controller 80 controls the static electricity removal power source 11B in such a way as to apply a static electricity removal voltage with a first value to the static electricity removal needle 11A. Then, in the case of forming an image on the second surface of the transfer material P which has waited for a predetermined time or more in the second conveyance path 91, the controller 80 controls the static electricity removal power source 11B in such a way as to apply a static electricity removal voltage with a second value larger than the first value to the static electricity removal needle 11A. This enables preventing or reducing the occurrence of image defect and appropriately forming an image even with respect to the transfer material P with the resistance value thereof having increased due to the transfer material P waiting for a predetermined time or more in the second conveyance path 91.

Additionally, implementing the first exemplary embodiment and the second exemplary embodiment in combination also enables preventing or reducing the occurrence of image defect and appropriately forming an image even with respect to the transfer material P with the resistance value thereof having increased due to the transfer material P waiting for a predetermined time or more in the second conveyance path 91.

While the present disclosure has been described above based on exemplary embodiments adapted to a color image forming apparatus, the present disclosure is not limited to the above-described exemplary embodiments. The present disclosure can be applied to any apparatus which includes a transfer member configured to transfer a toner image from an image bearing member to a transfer material and a second conveyance path provided in vicinity to a fixing unit. In other words, the present disclosure can also be applied to a monochrome image forming apparatus which includes a photosensitive drum (photosensitive member) serving as an image bearing member, a transfer roller serving as a transfer member configured to be in contact with the photosensitive drum, and a second conveyance path configured to be used to perform double-sided printing.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of priority from Japanese Patent Application No. 2018-123749, filed Jun. 28, 2018, which is hereby incorporated by reference herein in its entirety.

What is claimed is:

1. An image forming apparatus comprising:

a container unit configured to contain a transfer material;

an image bearing member configured to bear a toner image;

a transfer member configured to be in contact with the image bearing member to form a transfer portion to transfer a toner image from the image bearing member to a transfer material;

a transfer power source configured to apply a voltage to the transfer member;

a fixing unit located on a downstream side of the transfer portion in a transfer material conveyance direction and configured to fix a toner image to a transfer material by heating the transfer material;

a first conveyance path configured to guide a transfer material being conveyed from the container unit toward the transfer portion;

a second conveyance path configured to join the first conveyance path and to guide a transfer material on which an image has been formed on a first surface and which, after passing through the fixing unit, is re-conveyed to the transfer portion, wherein a toner image is transferred to a second surface of the transfer material opposite to the first surface at the transfer portion; and a control unit configured to control the transfer power source such that, in transferring a toner image, a current having a predetermined value flows from the transfer member toward the image bearing member, wherein the control unit controls the transfer power source such that a current having a first value flows from the transfer member toward the image bearing member in a case where the transfer material with an image formed on the first surface thereof has been conveyed for less than a predetermined time in the second conveyance path, and controls the transfer power source such that a current having a second value larger in absolute value than the first value flows from the transfer member toward the image bearing member in a case where the transfer material with an image formed on the first surface thereof is conveyed to the transfer portion after waiting for the predetermined amount of time or more in the second conveyance path.

2. The image forming apparatus according to claim 1, wherein the second conveyance path has a region located on an upstream side of a downstream end portion of a position at which the fixing unit is provided with respect to the transfer material conveyance direction in the second conveyance path, and the region of the second conveyance path is warmed by heat from the fixing unit.

3. The image forming apparatus according to claim 1, wherein the control unit transfers a toner image to the first surface in the transfer portion by applying a voltage, having a polarity opposite to a normal charging polarity of toner, from the transfer power source to the transfer member such that a current having the first value flows from the transfer member toward the image bearing member.

4. The image forming apparatus according to claim 1, wherein the control unit transfers a toner image to the second surface in the transfer portion by controlling the transfer power source such that a current having the first value or a current having the second value flows from the transfer member toward the image bearing member.

5. The image forming apparatus according to claim 1, further comprising a static electricity removal unit located on a downstream side of the transfer portion and on an upstream side of the fixing unit with respect to the transfer material conveyance direction and configured to remove static electricity of a transfer material with a toner image transferred thereto in the transfer portion, wherein the static electricity removal unit includes a static electricity removal member located opposite to a surface of a transfer material pinched in the transfer portion on a side which is in contact with the transfer member, and a static electricity removal power source configured to apply a voltage to the static electricity removal member.

6. The image forming apparatus according to claim 5, wherein the control unit controls the static electricity removal power source to apply a voltage having the same polarity as a normal charging polarity of toner to the static electricity removal member, thus removing static electricity of a transfer material passing through the transfer portion, and wherein, in a case where the transfer material with an image formed on the first surface thereof is conveyed to the transfer portion after waiting for the predetermined amount of time or more in the second conveyance path, the control unit controls the static electricity removal power source to apply, to the static electricity removal member, a voltage larger in absolute value than a voltage applied to the static electricity removal member when the transfer material passes through the transfer portion in a state in which the first surface of the transfer material faces the image bearing member.

7. The image forming apparatus according to claim 1, further comprising a detection unit provided in the second conveyance path and configured to detect a leading edge or a trailing edge of a transfer material being conveyed, wherein the control unit includes a counter configured to count an elapsed time from detection timing of a transfer material by the detection unit, and wherein the control unit determines whether an amount of time for which the transfer material has waited in the second conveyance path is greater than or equal to the predetermined amount of time, based on detection timing of a leading edge or a trailing edge of the transfer material with an image formed on the first surface thereof by the detection unit and based on the counter.

8. The image forming apparatus according to claim 1, further comprising a photosensitive member, wherein the image bearing member is an endless intermediate transfer member configured to bear a toner image transferred from the photosensitive member.

9. The image forming apparatus according to claim 8, further comprising:

a contact member configured to come into contact with the photosensitive member to recover toner adhering to the photosensitive member;

a primary transfer member configured to be in contact with an inner circumferential surface of the intermediate transfer member and to form a primary transfer portion at which the photosensitive member and the intermediate transfer member are in contact with each other;

a primary transfer power source configured to apply a voltage to the primary transfer member;

a charging member located on a downstream side of the transfer portion and on an upstream side of a position at which the photosensitive member and the intermediate transfer member are in contact with each other with respect to a movement direction of the intermediate transfer member, and configured to electrically charge toner having passed through the transfer portion while being in contact with an outer circumferential surface of the intermediate transfer member; and a charging power supply configured to apply a voltage to the charging member, wherein the primary transfer power source applies a voltage having a polarity opposite to a normal charging polarity of toner to the primary transfer member, thus transferring a toner image borne on the photosensitive member to the intermediate transfer member, and wherein the control unit applies a voltage having the opposite polarity from the charging power source to the charging member and applies a voltage having the opposite polarity from the primary transfer power source to the primary transfer member, thus performing a first recovery operation of causing toner having passed through the transfer portion to move from the intermediate transfer member to the photosensitive member in the primary transfer portion and then causing the contact member to recover the toner having moved to the photosensitive member.

10. The image forming apparatus according to claim 9, wherein the control unit applies a voltage having the opposite polarity from the primary transfer power source to the primary transfer member, thus performing the first recovery operation while transferring a toner image from the photosensitive member to the intermediate transfer member.

11. The image forming apparatus according to claim 9, wherein the control unit applies a voltage having the same polarity as a normal charging polarity of toner from the charging power source to the charging member and applies a voltage having the same polarity from the primary transfer power source to the primary transfer member, thus performing a second recovery operation of causing toner adhering to the charging member to move from the charging member to the intermediate transfer member and causing toner having moved to the intermediate transfer member to move from the intermediate transfer member to the photosensitive member in the primary transfer portion and then causing the contact member to recover the toner having moved to the photosensitive member.

12. The image forming apparatus according to claim 11, wherein, when performing the second recovery operation while the transfer material with an image formed on the first surface thereof is situated in the second conveyance path, the control unit causes the transfer material to wait in the second conveyance path until the second recovery operation is completed.

13. The image forming apparatus according to claim 1, wherein the control unit performs dehumidification control to temporarily interrupt an image forming operation and cause the fixing unit to operate to dehumidify an inside of the image forming apparatus, and, when performing the dehumidification control while the transfer material with an image formed on the first surface thereof is situated in the second conveyance path, the control unit causes the transfer material to wait in the second conveyance path until the dehumidification control is completed.

14. The image forming apparatus according to claim 1, further comprising a developing unit configured to supply toner to the image bearing member, wherein the image bearing member is a photosensitive member, an electrostatic latent image on which is developed by the developing unit.

15. An image forming apparatus comprising:

a container unit configured to contain a transfer material;

an image bearing member configured to bear a toner image;

a transfer member configured to be in contact with the image bearing member to form a transfer portion to transfer a toner image from the image bearing member to a transfer material;

a transfer power source configured to apply a voltage to the transfer member;

a fixing unit located on a downstream side of the transfer portion in a transfer material conveyance direction and configured to fix a toner image to a transfer material by heating the transfer material;

a first conveyance path configured to guide a transfer material being conveyed from the container unit toward the transfer portion;

a second conveyance path configured to join the first conveyance path and to guide a transfer material on which an image has been formed on a first surface and which, after passing through the fixing unit, is reconveyed to the transfer portion, wherein a toner image is transferred to a second surface of the transfer material opposite to the first surface at the transfer portion; and a control unit configured to control the transfer power source such that, in transferring a toner image to the first surface, a current having a first value flows from the transfer member toward the image bearing member, wherein the control unit controls the transfer power source such that a current having a second value larger in absolute value than the first value flows from the transfer member toward the image bearing member in a case where the transfer material with an image formed on the first surface thereof is conveyed to the transfer portion after waiting for a predetermined amount of time or more in the second conveyance path.

16. The image forming apparatus according to claim 15, wherein the second conveyance path has a region located on an upstream side of a downstream end portion of a position at which the fixing unit is provided with respect to the transfer material conveyance direction in the second conveyance path, and the region of the second conveyance path is warmed by heat from the fixing unit.

17. The image forming apparatus according to claim 15, wherein the control unit transfers a toner image to the first surface or the second surface in the transfer portion by applying a voltage having a polarity opposite to a normal charging polarity of toner from the transfer power source to the transfer member.

18. The image forming apparatus according to claim 15, wherein, in a case where the transfer material with an image formed on the first surface thereof does not wait for the predetermined amount of time or more in the second conveyance path, the control unit controls the transfer power source such that a current having the first value flows from the transfer member toward the image bearing member.

19. The image forming apparatus according to claim 15, further comprising a static electricity removal unit located on a downstream side of the transfer portion and on an upstream side of the fixing unit with respect to the transfer material conveyance direction and configured to remove static electricity of a transfer material with a toner image transferred thereto in the transfer portion, wherein the static electricity removal unit includes a static electricity removal member located opposite to a surface of a transfer material pinched in the transfer portion on a side which is in contact with the transfer member, and a static electricity removal power source configured to apply a voltage to the static electricity removal member.

20. The image forming apparatus according to claim 19, wherein the control unit controls the static electricity removal power source to apply a voltage having the same polarity as a normal charging polarity of toner to the static electricity removal member, thus removing static electricity of a transfer material passing through the transfer portion, and wherein, in a case where the transfer material with an image formed on the first surface thereof is conveyed to the transfer portion after waiting for the predetermined amount of time or more in the second conveyance path, the control unit controls the static electricity removal power source to apply, to the static electricity removal member, a voltage larger in absolute value than a voltage applied to the static electricity removal member when the transfer material passes through the transfer portion in a state in which the first surface of the transfer material faces the image bearing member.

21. The image forming apparatus according to claim 15, further comprising a detection unit provided in the second conveyance path and configured to detect a leading edge or a trailing edge of a transfer material being conveyed, wherein the control unit includes a counter configured to count an elapsed time from detection timing of a transfer material by the detection unit, and wherein the control unit determines whether an amount of time for which the transfer material has waited in the second conveyance path is greater than or equal to the predetermined amount of time, based on detection timing of a leading edge or a trailing edge of the transfer material with an image formed on the first surface thereof by the detection unit and based on the counter.

22. The image forming apparatus according to claim 15, further comprising a photosensitive member, wherein the image bearing member is an endless intermediate transfer member configured to bear a toner image transferred from the photosensitive member.

23. The image forming apparatus according to claim 22, further comprising:

a contact member configured to come into contact with the photosensitive member to recover toner adhering to the photosensitive member;

a primary transfer member configured to be in contact with an inner circumferential surface of the intermediate transfer member and to form a primary transfer portion at which the photosensitive member and the intermediate transfer member are in contact with each other;

a primary transfer power source configured to apply a voltage to the primary transfer member;

a charging member located on a downstream side of the transfer portion and on an upstream side of a position at which the photosensitive member and the intermediate transfer member are in contact with each other with respect to a movement direction of the intermediate transfer member, and configured to electrically charge toner having passed through the transfer portion while being in contact with an outer circumferential surface of the intermediate transfer member; and a charging power supply configured to apply a voltage to the charging member, wherein the primary transfer power source applies a voltage having a polarity opposite to a normal charging polarity of toner to the primary transfer member, thus transferring a toner image borne on the photosensitive member to the intermediate transfer member, and wherein the control unit applies a voltage having the opposite polarity from the charging power source to the charging member and applies a voltage having the opposite polarity from the primary transfer power source to the primary transfer member, thus performing a first recovery operation of causing toner having passed through the transfer portion to move from the intermediate transfer member to the photosensitive member in the primary transfer portion and then causing the contact member to recover the toner having moved to the photosensitive member.

24. The image forming apparatus according to claim 23, wherein the control unit applies a voltage having the opposite polarity from the primary transfer power source to the primary transfer member, thus performing the first recovery operation while transferring a toner image from the photosensitive member to the intermediate transfer member.

25. The image forming apparatus according to claim 23, wherein the control unit applies a voltage having the same polarity as a normal charging polarity of toner from the charging power source to the charging member and applies a voltage having the same polarity from the primary transfer power source to the primary transfer member, thus performing a second recovery operation of causing toner adhering to the charging member to move from the charging member to the intermediate transfer member and causing toner having moved to the intermediate transfer member to move from the intermediate transfer member to the photosensitive member in the primary transfer portion and then causing the contact member to recover the toner having moved to the photosensitive member.

26. The image forming apparatus according to claim 25, wherein, when performing the second recovery operation while the transfer material with an image formed on the first surface thereof is situated in the second conveyance path, the control unit causes the transfer material to wait in the second conveyance path until the second recovery operation is completed.

27. The image forming apparatus according to claim 15, wherein the control unit performs dehumidification control to temporarily interrupt an image forming operation and cause the fixing unit to operate to dehumidify an inside of the image forming apparatus, and, when performing the dehumidification control while the transfer material with an image formed on the first surface thereof is situated in the second conveyance path, the control unit causes the transfer material to wait in the second conveyance path until the dehumidification control is completed.

28. The image forming apparatus according to claim 15, further comprising a developing unit configured to supply toner to the image bearing member, wherein the image bearing member is a photosensitive member, an electrostatic latent image on which is developed by the developing unit.

* * * * *